US011293429B2

(12) United States Patent
Okaguchi et al.

(10) Patent No.: US 11,293,429 B2
(45) Date of Patent: Apr. 5, 2022

(54) FLUID CONTROL DEVICE

(71) Applicant: Murata Manufacturing Co., Ltd., Kyoto (JP)

(72) Inventors: Kenjiro Okaguchi, Kyoto (JP); Nobuhira Tanaka, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 210 days.

(21) Appl. No.: 16/538,962

(22) Filed: Aug. 13, 2019

(65) Prior Publication Data

US 2019/0360480 A1 Nov. 28, 2019

Related U.S. Application Data

(63) Continuation of application No. PCT/JP2018/006672, filed on Feb. 23, 2018.

(30) Foreign Application Priority Data

Feb. 27, 2017 (JP) ..... JP2017-034269
May 11, 2017 (JP) ..... JP2017-094527
Jan. 30, 2018 (JP) ..... JP2018-013503

(51) Int. Cl.
*F04B 49/06* (2006.01)
*F04B 17/00* (2006.01)
(Continued)

(52) U.S. Cl.
CPC ..... *F04B 45/047* (2013.01); *F04B 17/003* (2013.01); *F04B 43/046* (2013.01); *F04B 49/06* (2013.01); *F04B 49/103* (2013.01)

(58) Field of Classification Search
CPC .... F04B 45/047; F04B 17/003; F04B 43/046; F04B 49/06; F04B 49/103
See application file for complete search history.

(56) References Cited

U.S. PATENT DOCUMENTS 5,917,267 A 6/1999 Miyazawa et al.
2007/0080606 A1 4/2007 Hardy et al.
(Continued)

FOREIGN PATENT DOCUMENTS

JP S60-212275 A 10/1985
JP H09-191676 A 7/1997
(Continued)

OTHER PUBLICATIONS

English Translation of JP2007024418A (Year: 2021).*
(Continued)

*Primary Examiner* — Connor J Tremarche
(74) *Attorney, Agent, or Firm* — Pearne & Gordon LLP

(57) ABSTRACT

A fluid control device includes a piezoelectric pump having a piezoelectric element, a driving circuit that receives a driving power supply voltage applied thereto and drives the piezoelectric element, and a startup circuit disposed between the driving circuit and an input terminal for a power supply voltage. The startup circuit increases the driving power supply voltage to a voltage (V1) lower than a constant voltage (Vc) in a first stage (P1) after startup, maintains or decreases the driving power supply voltage in a second stage (P2) following the first stage (P1), and increases the driving power supply voltage to the constant voltage (Vc) in a third stage (P3) following the second stage (P2).

7 Claims, 27 Drawing Sheets

(51) Int. Cl.

| | |
|---|---|
| ***F04B 43/02*** | (2006.01) |
| ***F04B 43/04*** | (2006.01) |
| ***F04B 45/047*** | (2006.01) |
| ***F04B 49/10*** | (2006.01) |

(56) References Cited

U.S. PATENT DOCUMENTS

| | | | |
|---|---|---|---|
| 2012/0171062 | A1 | 7/2012 | Kodama et al. |
| 2017/0112697 | A1 | 4/2017 | Tanaka |

FOREIGN PATENT DOCUMENTS

| | | | | |
|---|---|---|---|---|
| JP | 2007-24418 | A | | 2/2007 |
| JP | 2007024418 | A | * | 2/2007 |
| JP | 2007-100704 | A | | 4/2007 |
| WO | 2011/145544 | A1 | | 11/2011 |
| WO | 2016/006677 | A1 | | 1/2016 |
| WO | 2016/121717 | A1 | | 8/2016 |

OTHER PUBLICATIONS

International Search Report for International Application No. PCT/JP2018/006672 dated May 29, 2018.
Written Opinion for International Application No. PCT/JP2018/006672 dated dated May 29, 2018.

* cited by examiner

FLUID CONTROL DEVICE

This is a continuation of International Application No. PCT/JP2018/006672 filed on Feb. 23, 2018 which claims priority from Japanese Patent Application No. 2017-034269 filed on Feb. 27, 2017, and claims priority from Japanese Patent Application No. 2017-094527 filed on May 11, 2017, and claims priority from Japanese Patent Application No. 2018-013503 filed on Jan. 30, 2018. The contents of these applications are incorporated herein by reference in their entireties.

BACKGROUND OF THE DISCLOSURE

Field of the Disclosure

The present disclosure relates to a fluid control device including a piezoelectric pump.

Description of the Related Art

Patent Document 1 describes an example of a fluid control device that controls a fluid by driving a piezoelectric element included in a piezoelectric pump. FIG. 34 is a cross-sectional view of a main part of a piezoelectric pump 105 disclosed in Patent Document 1.

The piezoelectric pump 105 includes a base plate 91, a thin top plate 51, a spacer 53A, a diaphragm supporting frame 61, a diaphragm 41, a piezoelectric element 42, a reinforcing plate 43, a spacer 53B, an electrode conduction plate 71, a spacer 53C, and a cover portion 54. The diaphragm 41, the piezoelectric element 42, and the reinforcing plate 43 constitute an actuator 40. The cover portion 54 has a discharge hole 55.

The base plate 91, which has a cylindrical opening portion 92 at the center thereof, is disposed under the thin top plate 51. A circular portion of the thin top plate 51 is exposed at the opening portion 92 of the base plate 91. The pressure fluctuations caused by vibration of the actuator 40 enable the exposed circular portion to vibrate at substantially the same frequency as that of the actuator 40. With this configuration of the thin top plate 51 and the base plate 91, the center or the vicinity of the center of a region facing the actuator of the thin top plate 51 serves as a thin plate portion capable of bending vibration, whereas the peripheral portion thereof serves as a thick plate portion that is substantially restrained. The natural frequency of this circular thin plate portion is designed so as to be equal to or slightly lower than the drive frequency of the actuator 40. Thus, the exposed portion of the thin top plate 51, having a center vent 52 at the center thereof, vibrates with a large amplitude in response to the vibration of the actuator 40. When the vibration phase of the thin top plate 51 delays (for example, by 90 degrees) relative to the vibration phase of the actuator 40, the fluctuations in the thickness of the gap between the thin top plate 51 and the actuator 40 substantially increase. As a result, the ability of the pump increases.

Patent Document 1: International Publication No. WO/2011/145544

BRIEF SUMMARY OF THE DISCLOSURE

Generally, however, in a piezoelectric pump whose diaphragm is vibrated by the driving of a piezoelectric element, an inrush current flows through a driving circuit and the piezoelectric element at the start of the driving of the piezoelectric element. If the inrush current is large, the possibility arises that the diaphragm and the thin top plate may be vibrated unstably, the piezoelectric body and the thin top plate may come into contact with each other, the piezoelectric body may crack, and thus the pump characteristics may significantly degrade. In addition, the inrush current does not contribute to the operation of the pump and is thus a factor of decreasing power efficiency.

Now, the above-mentioned unstable vibration in the piezoelectric pump including the actuator 40 and the thin top plate 51 illustrated in FIG. 34 will be described with reference to FIGS. 35A and 35B. In FIGS. 35A and 35B, V40 denotes a vibration waveform of the actuator 40, and V51 denotes a vibration waveform of the thin top plate 51. FIG. 35A illustrates a state where the actuator 40 and the thin top plate 51 are stably vibrated, whereas FIG. 35B illustrates a state where the actuator 40 and the thin top plate 51 are unstably vibrated.

As illustrated in FIG. 35A, during the stable vibration, the actuator 40 and the thin top plate 51 are operated while keeping a constant phase difference with the air interposed therebetween, and thus do not come into contact with each other.

However, if the amplitude of the actuator 40 at startup is large, coupling by the thin top plate 51 via the air is weak and the damping force of the actuator 40 via the air is weak, and thus a large amplitude occurs to produce a large current even if the driving voltage is the same.

As a result, the amplitudes of the actuator 40 and the thin top plate 51 become abnormally large. In addition, while the amplitudes are increasing, the actuator 40 and the thin top plate 51 may come into contact with each other because the phase difference therebetween is unstable. The cross mark in FIG. 35B represents the timing at which the actuator 40 and the thin top plate 51 collide with each other.

Such a collision between the actuator 40 and the thin top plate 51 may cause deformation, abrasion, or breakage of a structure such as the actuator 40 or the thin top plate 51.

Thus, it is important to suppress the amplitude under a state where the coupling between the actuator 40 and the thin top plate 51 via the air is weak.

In addition, an inrush current that occurs immediately after the start of the driving causes a voltage drop in the current path through which the inrush current flows and a temporary drop of a power supply voltage for the driving circuit. The power supply voltage may cause a malfunction of an MCU provided in a control circuit. Furthermore, when the piezoelectric pump is configured to stop operating when the power supply voltage reaches an operation-guaranteed lower limit voltage of the MCU in order to prevent the malfunction, the piezoelectric pump does not perform the predetermined operations. Furthermore, when a battery is used as a power supply, a decrease in the power supply voltage may cause the battery voltage to early decrease to a termination voltage, resulting in a shorter battery life.

A so-called soft-start circuit is available as a method for suppressing an inrush current generated when a power supply voltage is applied to an electric circuit or an electronic circuit as well as the piezoelectric pump. Basically, the soft-start circuit gradually increases a driving power supply voltage from zero to a constant voltage over time from the start of the startup.

FIG. 36 is a waveform diagram illustrating chronological changes in currents and flow rates of a fluid when the above-described soft-start circuit is applied to a boosting circuit for supplying a driving power supply voltage to a driving circuit of a piezoelectric pump. In FIG. 36, a waveform Ip represents a current in a case where the soft-start circuit is not provided, and a waveform Fp represents a flow rate in a case where the soft-start circuit is not provided. A waveform Is represents a current in a case where the soft-start circuit is provided, and a waveform Fs represents a flow rate in a case where the soft-start circuit is provided. When the soft-start circuit is not provided, an inrush current represented by the broken-line ellipse in FIG. 36 flows. Such an inrush current is suppressed by providing the soft-start circuit. In this case, however, the flow rate rises slowly, and a long time is taken until the flow rate becomes constant.

If the amplitude of the actuator 40, that is, the amplitude of a piezoelectric body, becomes too large, the piezoelectric body may crack and break down.

When the piezoelectric pump is used for aspiration for a living body, a too large aspiration power negatively affects the living body. For example, in sputum aspiration, an aspiration power of more than −20 kPa may damage the mucous membranes. In use for negative pressure wound therapy (NPWT), an aspiration power of more than −30 kPa may damage the affected part due to the excessive inhalation.

Accordingly, an object of the present disclosure is to provide a fluid control device for overcoming various defects in the case of using a piezoelectric pump, such as unstableness in startup, longer startup time, decrease in power efficiency, and a negative influence on a living body resulting from an excessive pressure.

(1) A fluid control device according to the present disclosure includes a piezoelectric pump having a piezoelectric element; a driving circuit that receives a driving power supply voltage applied thereto and drives the piezoelectric element; and a startup circuit disposed between the driving circuit and a power supply voltage input terminal. The startup circuit increases the driving power supply voltage for the driving circuit to a voltage lower than a constant voltage in a first stage after startup, maintains or decreases the driving power supply voltage in a second stage following the first stage, and increases the driving power supply voltage to the constant voltage in a third stage following the second stage.

With the above-described configuration, the driving power supply voltage does not reach the constant voltage in the first stage, and thus an inrush current is suppressed. After that, the driving power supply voltage is once maintained or decreased in the second stage, and is increased to the constant voltage in the third stage. Thus, the startup time is shortened.

Note that "the driving power supply voltage is maintained" in the second stage includes not only a state where the voltage is not changed at all but also a state where the voltage is substantially maintained although the voltage is slightly changed in the second stage.

(2) Preferably, the driving power supply voltage during a transition from the second stage to the third stage is higher than or equal to a voltage at a start of the first stage. Accordingly, the startup time until a constant state can be shortened with the driving voltage and driving current not being decreased too much in the second stage.

(3) For example, the startup circuit has a first circuit constituting a first path and a second circuit constituting a second path, the first circuit and the second circuit applying the driving power supply voltage to the driving circuit. The first circuit is a circuit that conducts over at least a period of the first stage from when the power supply voltage is applied to the input terminal and that does not conduct over a period of the third stage, and the second circuit is a circuit that conducts after the second stage. With this configuration, the first path to which the driving power supply voltage is applied in the first stage and the second path to which the driving power supply voltage is applied in the third stage are separated from each other, and thus the circuit configuration is simplified.

(4) For example, the first circuit is constituted by a first switch element that applies the driving power supply voltage to the driving circuit, and a first delay circuit that causes the first switch element to conduct over the period of the first stage from when the driving power supply voltage is applied and not to conduct over the period of the third stage. With this configuration, the configuration of the first circuit is simplified.

(5) For example, the first circuit is constituted by a first switch element that applies the driving power supply voltage to the driving circuit, and a diode that conducts in a reverse direction from when the driving power supply voltage is applied to when the second circuit comes into conduction. With this configuration, the Zener characteristic of the diode is used and the driving power supply voltage in the first stage is limited to suppress an inrush current with a simple circuit configuration.

(6) For example, the first switch element and the first delay circuit are constituted by a first MOS-FET, the first switch element is a parasitic transistor including a collector which is a drain of the first MOS-FET and an emitter which is a source of the first MOS-FET, and the first delay circuit is a CR time constant circuit constituted by a parasitic capacitor of the first MOS-FET formed between a base of the parasitic transistor and the collector, and a parasitic resistor of the first MOS-FET formed between the base and the emitter. With this configuration, the first switch element and the first delay circuit are constituted by a single component, and the circuit configuration is simplified.

(7) For example, the second circuit is constituted by a second switch element that applies the driving power supply voltage to the driving circuit, and a second delay circuit that causes the second switch element to conduct at an end of the second stage. With this configuration, the configuration of the second circuit is simplified.

(8) For example, the second circuit is constituted by a second MOS-FET and a second delay circuit, the second MOS-FET being connected in parallel to the first MOS-FET and having a p-type and n-type configuration reverse to a p-type and n-type configuration of the first MOS-FET, and the second delay circuit causes the second MOS-FET to conduct at an end of the second stage. With this configuration, the first circuit can be constituted by only the first MOS-FET, and the second circuit is constituted by the second MOS-FET and the second delay circuit. Thus, the overall circuit configuration is simplified.

(9) A fluid control device according to the present disclosure includes s piezoelectric pump having a piezoelectric element; a driving circuit that receives a driving power supply voltage applied thereto and drives the piezoelectric element; and a startup circuit that is disposed between the driving circuit and an input terminal for a power supply voltage and outputs the driving power supply voltage. The startup circuit includes a semiconductor element for controlling the driving power supply voltage. The startup circuit outputs the driving power supply voltage by using a first voltage rise period and a second voltage rise period. The first voltage rise period is a period over which the driving power supply voltage is increased to a voltage lower than a constant voltage by using a voltage division ratio for the power supply voltage between the driving circuit and a resistance element when the semiconductor element is in an off state. The second voltage rise period is a period over which the driving power supply voltage is gradually increased to the constant voltage by using an unsaturated region of the semiconductor element.

With this configuration, a situation can be prevented from occurring where the voltage suddenly reaches the constant voltage after startup, and the time from the startup to when the voltage reaches the constant voltage can be shortened.

(10) In the fluid control device according to the present disclosure, it is preferable that the startup circuit further include a reset circuit that resets output control of the driving power supply voltage using the first voltage rise period and the second voltage rise period.

With this configuration, the above-described control of the driving power supply voltage at startup can be repeatedly performed more accurately.

(11) A fluid control device according to the present disclosure includes a piezoelectric pump having a piezoelectric element; a driving circuit that receives a driving power supply voltage applied thereto and outputs a driving voltage to the piezoelectric element; and a drive control circuit that controls the driving power supply voltage and supplies the driving power supply voltage to the driving circuit. The drive control circuit includes a switch that selects supply of the driving power supply voltage to the driving circuit, a current detection circuit that detects a control current corresponding to the driving voltage, and a control IC that outputs a control trigger to the switch by using the control current, the control trigger controlling supply of the driving power supply voltage. The control IC generates the control trigger for opening the switch when detecting that a value of the control current after a predetermined time exceeds a control threshold value that is based on a value of the control current immediately after startup.

With this configuration, excessive voltage supply to the piezoelectric element is suppressed.

(12) A fluid control device according to the present disclosure includes a piezoelectric pump having a piezoelectric element; a driving circuit that receives a driving power supply voltage applied thereto and outputs a driving voltage to the piezoelectric element; and a drive control circuit that controls the driving power supply voltage and supplies the driving power supply voltage to the driving circuit. The drive control circuit includes a switch that selects supply of the driving power supply voltage to the driving circuit, a current detection circuit that detects a control current corresponding to the driving voltage and outputs a detection signal, a time constant circuit that generates a delay signal of the detection signal, and a comparator that generates a control trigger for opening the switch when the delay signal is at a level higher than or equal to a level of the detection signal.

With this configuration, the excessive voltage supply to the piezoelectric element is suppressed.

(13) For example, the drive control circuit includes a discharge circuit that selectively leads the control trigger signal to a ground. This configuration facilitates re-supply of the driving voltage after stopping supply of the driving voltage.

(14) A fluid control device according to the present disclosure may have the following configuration. The fluid control device includes a piezoelectric pump that includes a pump chamber having a piezoelectric element and a valve chamber communicating with the pump chamber and having a valve and that has a pump chamber opening which allows the pump chamber to communicate with an outside-pump-chamber space and a valve chamber opening which allows the valve chamber to communicate with an outside-valve-chamber space; a driving circuit that receives a driving power supply voltage applied thereto and drives the piezoelectric element; and a drive control circuit that is connected between the driving circuit and an input terminal for a power supply voltage and outputs the driving power supply voltage to the driving circuit. The outside-pump-chamber space and the valve chamber do not directly communicate with each other, but communicate with each other via the pump chamber. The outside-valve-chamber space and the pump chamber do not directly communicate with each other, but communicate with each other via the valve chamber. The outside-pump-chamber space and the outside-valve-chamber space do not directly communicate with each other, but communicate with each other via the pump chamber and the valve chamber. The drive control circuit adjusts the driving power supply voltage or a driving current corresponding to the driving power supply voltage in accordance with a differential pressure between the outside-pump-chamber space and the outside-valve-chamber space.

This configuration is based on that the vibration mode of the valve varies according to the differential pressure, and the driving power supply voltage or the driving current is adjusted in accordance with the vibration mode of the valve. Accordingly, the collision state of the valve with the wall constituting the valve chamber is adjusted.

(15) In the fluid control device according to the present disclosure, it is preferable that the drive control circuit increase the driving power supply voltage or the driving current in accordance with an increase in the differential pressure. With this configuration, the collision of the valve with the wall of the valve chamber opposite to the wall of the valve chamber near the pump chamber is suppressed.

(16) In the fluid control device according to present disclosure, for example, the drive control circuit may increase the driving power supply voltage or the driving current in a continuous manner. This configuration increases the drive efficiency while suppressing the collision with the valve.

(17) In the fluid control device according to present disclosure, for example, the drive control circuit may increase the driving power supply voltage or the driving current in a stepwise manner. This configuration simplifies control while suppressing the collision with the valve.

(18) In the fluid control device according to present disclosure, for example, the drive control circuit may perform control to increase the driving power supply voltage only once during driving. This configuration further simplifies control.

(19) In the fluid control device according to present disclosure, for example, the drive control circuit may perform control so that the driving power supply voltage or the driving current at a predetermined first differential pressure larger than a minimum value of the differential pressure becomes higher than the driving power supply voltage or the driving current at the minimum value. This configuration makes the above-described control using the differential pressure more reliable.

(20) In the fluid control device according to present disclosure, for example, the first differential pressure may be an average of the minimum value of the differential pressure and a maximum value of the differential pressure. This configuration makes the above-described control using the differential pressure more reliable and relatively increases the drive efficiency.

(21) In the fluid control device according to present disclosure, for example, the drive control circuit may decrease the driving power supply voltage or the driving current in accordance with an increase in the differential pressure.

With this configuration, the collision of the valve with the wall of the valve chamber near the pump chamber is suppressed.

(22) In the fluid control device according to present disclosure, for example, the drive control circuit may decrease the driving power supply voltage or the driving current in a continuous manner. This configuration increases the drive efficiency while suppressing the collision with the valve.

(23) In the fluid control device according to present disclosure, for example, the drive control circuit may decrease the driving power supply voltage or the driving current in a stepwise manner. This configuration simplifies control while suppressing the collision with the valve.

(24) In the fluid control device according to present disclosure, for example, the drive control circuit may perform control to decrease the driving power supply voltage only once during driving. This configuration further simplifies control.

(25) In the fluid control device according to present disclosure, for example, the drive control circuit may perform control so that the driving power supply voltage or the driving current at a maximum value of the differential pressure becomes lower than the driving power supply voltage or the driving current at a predetermined first differential pressure smaller than the maximum value of the differential pressure. This configuration makes the above-described control using the differential pressure more reliable.

(26) In the fluid control device according to present disclosure, the predetermined first differential pressure may be an average of a minimum value of the differential pressure and the maximum value of the differential pressure. This configuration makes the above-described control using the differential pressure more reliable and relatively increases the drive efficiency.

(27) In the fluid control device according to present disclosure, the drive control circuit may perform control to increase the driving power supply voltage or the driving current in accordance with an increase in the differential pressure and then perform control to decrease the driving power supply voltage or the driving current in accordance with an increase in the differential pressure.

With this configuration, the collision of the valve with the wall of the valve chamber is suppressed.

(28) A fluid control device according to the present disclosure may have the following configuration. The fluid control device includes a piezoelectric pump that includes a pump chamber having a piezoelectric element and a valve chamber communicating with the pump chamber and having a valve and that has a pump chamber opening which allows the pump chamber to communicate with an outside-pump-chamber space and a valve chamber opening which allows the valve chamber to communicate with an outside-valve-chamber space; a driving circuit that receives a driving power supply voltage applied thereto and drives the piezoelectric element; and a drive control circuit that is disposed between the driving circuit and an input terminal for a power supply voltage and outputs the driving power supply voltage to the driving circuit. The outside-pump-chamber space and the valve chamber do not directly communicate with each other, but communicate with each other via the pump chamber. The outside-valve-chamber space and the pump chamber do not directly communicate with each other, but communicate with each other via the valve chamber. The outside-pump-chamber space and the outside-valve-chamber space do not directly communicate with each other, but communicate with each other via the pump chamber and the valve chamber. The drive control circuit adjusts the driving power supply voltage or a driving current corresponding to the driving power supply voltage in accordance with a time elapsed from a supply start time of the driving power supply voltage.

This configuration uses the one-to-one relationship between the differential pressure and the time elapsed. Furthermore, this configuration is based on that the vibration mode of the valve varies according to the time elapsed, and the driving power supply voltage or the driving current is adjusted in accordance with the vibration mode of the valve. Accordingly, the collision state of the valve with the wall constituting the valve chamber is adjusted.

(29) In the fluid control device according to present disclosure, it is preferable that the drive control circuit increases the driving power supply voltage or the driving current in accordance with the time elapsed from the supply start time. With this configuration, the collision of the valve with the wall of the valve chamber opposite to the wall of the valve chamber near the pump chamber is suppressed.

(30) In the fluid control device according to present disclosure, for example, the drive control circuit may increase the driving power supply voltage or the driving current in a continuous manner. This configuration increases the drive efficiency while suppressing the collision with the valve.

(31) In the fluid control device according to present disclosure, for example, the drive control circuit may increase the driving power supply voltage or the driving current in a stepwise manner. This configuration simplifies control while suppressing the collision with the valve.

(32) In the fluid control device according to present disclosure, the drive control circuit may perform control to increase the driving power supply voltage only once during driving. This configuration further simplifies control.

(33) In the fluid control device according to present disclosure, for example, the drive control circuit may perform control so that the driving power supply voltage or the driving current at an intermediate time between the supply start time and a supply stop time of the driving power supply voltage becomes higher than the driving power supply voltage or the driving current immediately after the supply start time. This configuration makes the above-described control using the differential pressure more reliable.

(34) In the fluid control device according to present disclosure, for example, the intermediate time may be a time calculated by adding half a time difference between the supply start time and the supply stop time to the supply start time. This configuration makes the above-described control using the differential pressure more reliable and relatively increases the drive efficiency.

(35) In the fluid control device according to present disclosure, for example, the drive control circuit may decrease the driving power supply voltage or the driving current at a supply stop time of the driving power supply voltage below the driving power supply voltage or the driving current before the supply stop time.

With this configuration, the collision of the valve with the wall of the valve chamber near the pump chamber is suppressed.

(36) In the fluid control device according to present disclosure, for example, the drive control circuit may decrease the driving power supply voltage or the driving current in a continuous manner. This configuration increases the drive efficiency while suppressing the collision with the valve.

(37) In the fluid control device according to present disclosure, for example, the drive control circuit may decrease the driving power supply voltage or the driving current in a stepwise manner. This configuration simplifies control while suppressing the collision with the valve.

(38) In the fluid control device according to present disclosure, for example, the drive control circuit may perform control to decrease the driving power supply voltage only once during driving. This configuration further simplifies control.

(39) In the fluid control device according to present disclosure, for example, the drive control circuit may perform control so that the driving power supply voltage or the driving current immediately before the supply stop time becomes lower than the driving power supply voltage or the driving current at an intermediate time before the supply stop time. This configuration makes the above-described control using the differential pressure more reliable.

(40) In the fluid control device according to present disclosure, the intermediate time may be a time calculated by subtracting half a time difference between the supply start time and the supply stop time from the supply stop time. This configuration makes the above-described control using the differential pressure more reliable and relatively increases the drive efficiency.

(41) In the fluid control device according to present disclosure, it is preferable that the drive control circuit perform control to increase the driving power supply voltage or the driving current in accordance with a time elapsed from a start of driving and then perform control to decrease the driving power supply voltage or the driving current in accordance with the time elapsed.

With this configuration, the collision of the valve with the wall of the valve chamber is suppressed.

According to the present invention, in a fluid control device including a piezoelectric pump, various defects in the case of using the piezoelectric pump can be overcome.

DETAILED DESCRIPTION OF THE DISCLOSURE

Figure 1:
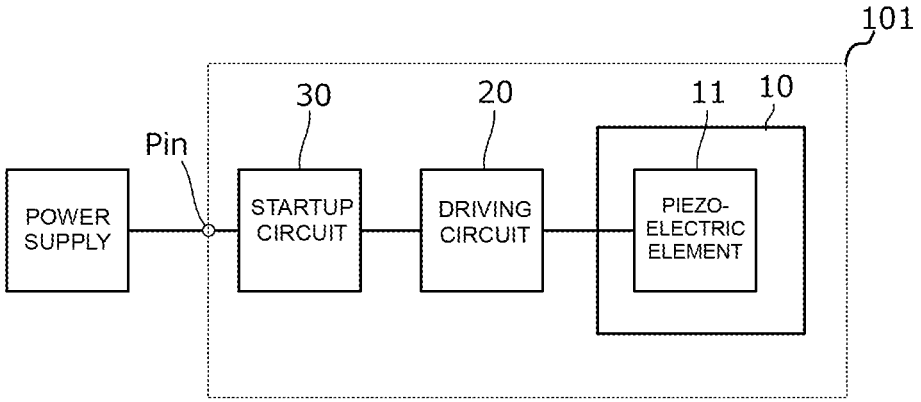
FIG. 1 is a block diagram illustrating the configuration of a fluid control device 101 according to a first embodiment.

Hereinafter, a plurality of embodiments of the present disclosure will be described using specific examples with reference to the drawings. In the drawings, the same parts are denoted by the same reference numerals. To describe important points or facilitate understanding, a plurality of embodiments will individually be described for convenience, but elements in different embodiments may partially be replaced or combined. In each embodiment, duplicate description about the same points will be omitted, and description will particularly be given of different points. Similar functions and effects obtained from similar configurations will not be described in each embodiment.

First Embodiment

FIG. 1 is a block diagram illustrating the configuration of a fluid control device 101 according to a first embodiment. The fluid control device 101 includes a piezoelectric pump 10 having a piezoelectric element 11, a driving circuit 20 that receives a driving power supply voltage Vdd applied thereto and drives the piezoelectric element 11, and a startup circuit 30 disposed between a power supply voltage input terminal Pin and the driving circuit 20.

Figure 34:
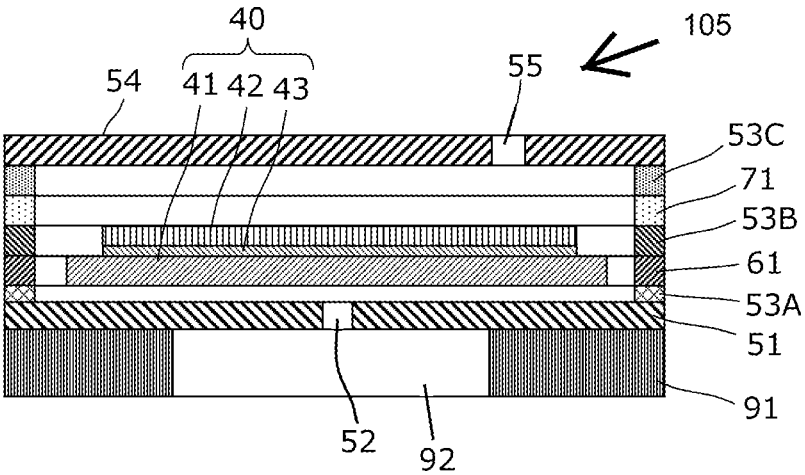
FIG. 34 is a cross-sectional view of a main part of a piezoelectric pump 105 disclosed in Patent Document 1.
Figure 35A:
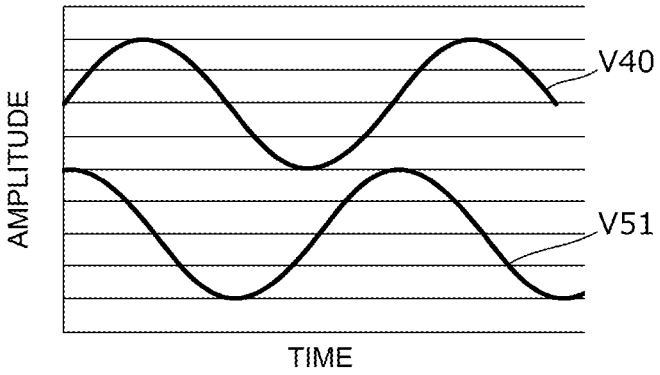
FIGS. 35A and 35B illustrate vibration waveforms of an actuator and a thin top plate.
Figure 35B:
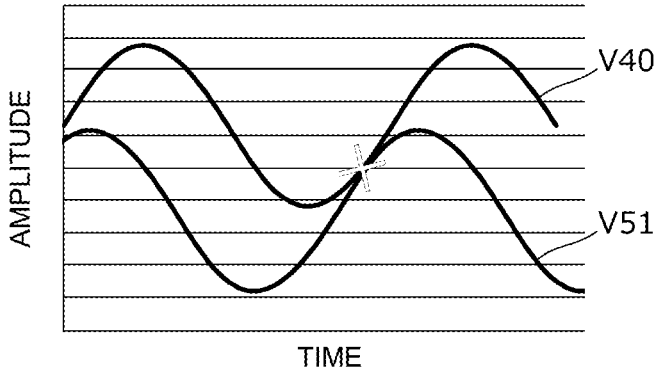
Figure 36:
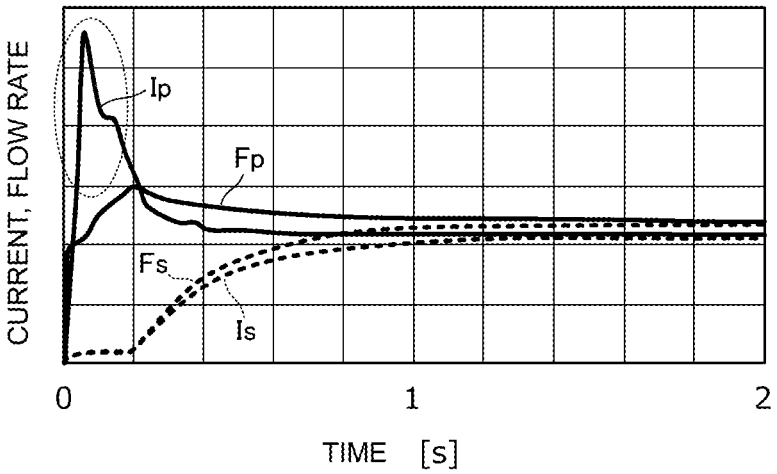
FIG. 36 is a waveform diagram illustrating chronological changes in currents and flow rates of a fluid when a soft-start circuit is applied to a boosting circuit for supplying a driving power supply voltage to a driving circuit of a piezoelectric pump.

The configuration of the piezoelectric pump 10 is the same as that of the piezoelectric pump 105 illustrated in FIG. 34, and the configuration of the piezoelectric element 11 is the same as that of the piezoelectric element 42 illustrated in FIG. 34.

The driving circuit 20 includes an oscillation circuit that oscillates by using a DC driving power supply voltage as a power supply and a harmonic filter, and supplies a substantially sinusoidal voltage to the piezoelectric element 11.

The startup circuit 30 increases a driving power supply voltage for the driving circuit 20 to a voltage lower than a constant voltage in a first stage after startup, maintains or decreases the driving power supply voltage in a second stage following the first stage, and increases the driving power supply voltage to a constant voltage in a third stage following the second stage.

Figure 2A:
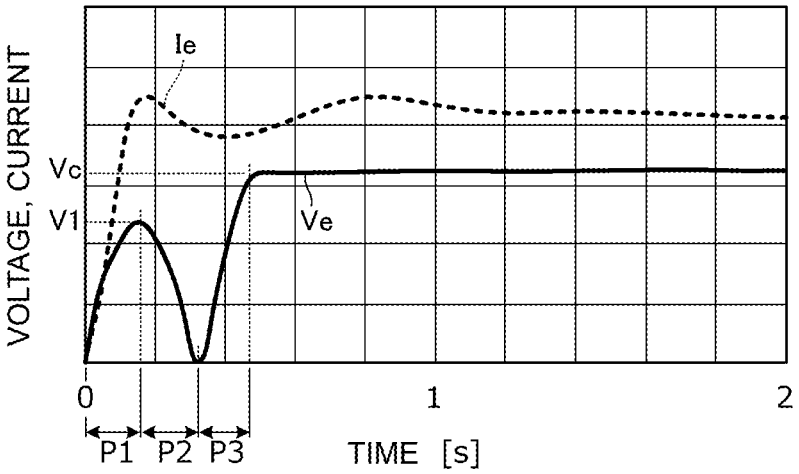
FIGS. 2A and 2B are graphs illustrating chronological changes in the driving power supply voltage applied to a driving circuit 20 and chronological changes in the current flowing through the driving circuit 20.
Figure 2B:
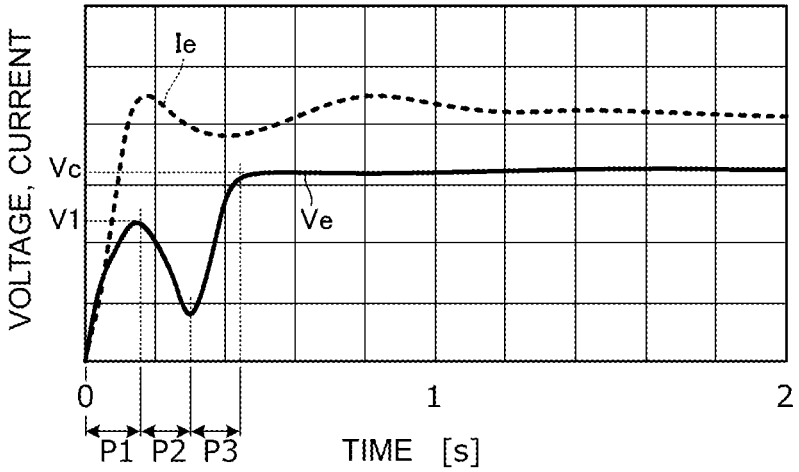
Figure 3:
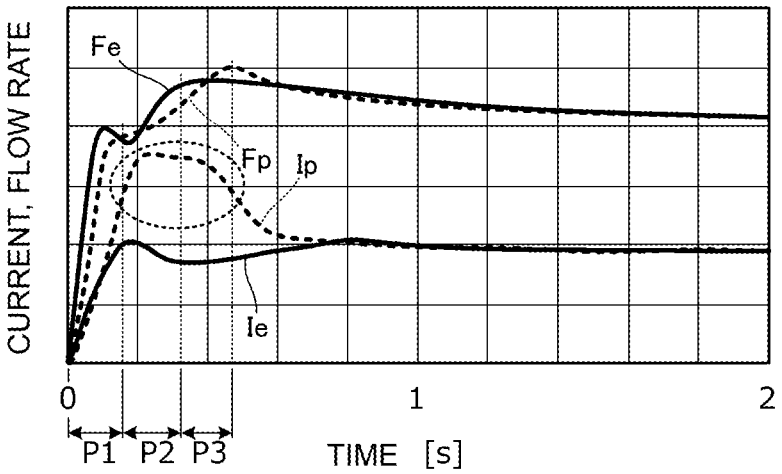
FIG. 3 is a graph illustrating chronological changes in the current flowing through the driving circuit 20 and chronological changes in the flow rate, in the fluid control device 101 according to the first embodiment and a fluid control device according to a comparative example.

FIGS. 2A and 2B are graphs illustrating examples of chronological changes in the driving power supply voltage applied to the driving circuit 20 and chronological changes in the current flowing through the driving circuit 20. FIG. 3 is a graph illustrating chronological changes in the current flowing through the driving circuit 20 and chronological changes in the flow rate, in the fluid control device 101 according to the present embodiment and a fluid control device according to a comparative example. The fluid control device according to the comparative example does not include a startup circuit that controls a driving power supply voltage at startup.

In FIGS. 2A and 2B, a waveform Ve represents chronological changes in the driving power supply voltage, and a waveform Ie represents chronological changes in the current flowing through the driving circuit. In FIGS. 2A and 2B, the period of time of a second stage P2 is different. As illustrated in FIGS. 2A and 2B, the driving power supply voltage increases to a voltage V1 lower than a constant voltage Vc in a first stage P1, and the driving power supply voltage decreases in the second stage P2. In the following third stage P3, the driving power supply voltage increases to the constant voltage Vc. The constant voltage is a voltage at which predetermined pump characteristics set in advance for the piezoelectric pump 10 can be obtained.

The power supply illustrated in FIG. 1 is, for example, a battery of about 16 V to 18 V, and the constant voltage Vc is substantially equal to the battery voltage. The peak voltage V1 in the first stage P1 is, for example, lower than the constant voltage Vc by about 2 V to 3 V.

In FIG. 3, a waveform Ie represents chronological changes in the current flowing through the driving circuit 20, and a waveform Ip represents chronological changes in the current flowing through the driving circuit in the fluid control device according to the comparative example. A waveform Fe represents chronological changes in the flow rate of a fluid flowing through the piezoelectric pump 10, and a waveform Fp represents chronological changes in the flow rate of a fluid flowing through the piezoelectric pump in the fluid control device according to the comparative example. As illustrated in FIG. 3, in the fluid control device according to the comparative example, the current peaks after about 0.2 seconds from the start of the startup, and an inrush current flows as enclosed in the broken-line ellipse. On the other hand, in the fluid control device 101 according to the present embodiment, an inrush current does not occur or is sufficiently suppressed. In the fluid control device according to the comparative example, the flow rate peaks after about 0.5 seconds from the start of the startup. In the fluid control device 101 according to the present embodiment, the flow rate peaks by the third stage P3. The peak value is equivalent to that of the fluid control device according to the comparative example. In the fluid control device 101 according to the present embodiment, the first peak of the flow rate is in the first stage P1, that is, the startup is quickly performed.

As illustrated in FIGS. 2A and 2B, the amount of decrease in the driving voltage in the second stage P2 is determined by the period of time of the second stage P2. By determining the period of time of the second stage P2 so that the driving voltage in the second stage P2 is higher than or equal to the voltage at the start of the first stage (0 V), the startup time until a constant state can be shortened.

Figure 4:
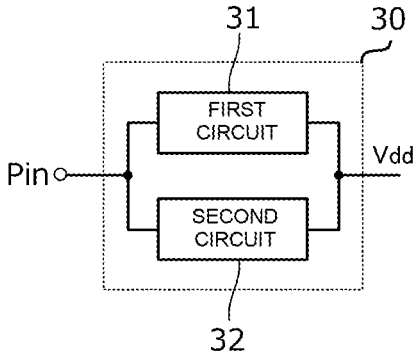
FIG. 4 is a block diagram illustrating the configuration of a startup circuit 30.

FIG. 4 is a block diagram illustrating the configuration of the startup circuit 30. The startup circuit 30 has a first circuit 31 constituting a first path and a second circuit 32 constituting a second path. The first circuit 31 and the second circuit 32 apply a driving power supply voltage to the driving circuit. The first circuit 31 and the second circuit 32 are connected in parallel to each other. The first circuit 31 conducts over the period of the first stage from when a power supply voltage is applied to the power supply voltage input terminal and does not conduct over the period of the third stage. The second circuit 32 conducts after the second stage. With this configuration, the first path to which a driving power supply voltage is applied in the first stage and the second path to which a driving power supply voltage is applied in the third stage are separated from each other, and thus the circuit configuration is simplified.

Figure 5:
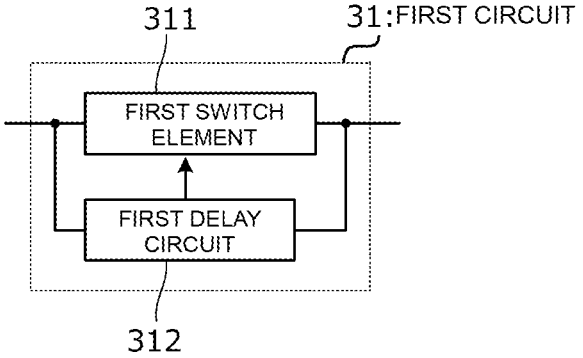
FIG. 5 is a block diagram illustrating the configuration of a first circuit 31.

FIG. 5 is a block diagram illustrating the configuration of the first circuit 31. The first circuit 31 is constituted by a first switch element 311 that applies a driving power supply voltage to the driving circuit, and a first delay circuit 312 that causes the first switch element 311 to conduct only during the period of the first stage after the driving power supply voltage is applied. With this configuration, the configuration of the first circuit 31 is simplified.

Figure 6:
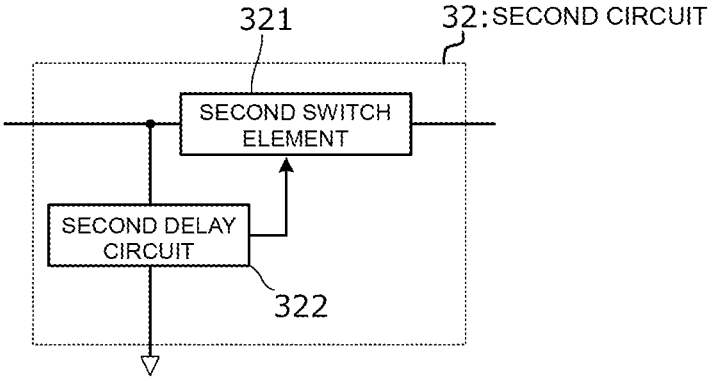
FIG. 6 is a block diagram illustrating the configuration of a second circuit 32.

FIG. 6 is a block diagram illustrating the configuration of the second circuit 32. The second circuit 32 is constituted by a second switch element 321 that applies a driving power supply voltage to the driving circuit, and a second delay circuit 322 that causes the second switch element 321 to conduct at the end of the second stage. The delay time of the second delay circuit 322 determines the timing of transition from the second stage P2 to the third stage P3 illustrated in FIGS. 2A and 2B, and FIG. 3, that is, the period of the time of the second stage P2. Thus, by determining the delay time of the second delay circuit 322, the lower limit of the driving power supply voltage during the transition from the second stage P2 to the third stage P3 can be determined as illustrated in FIGS. 2A and 2B.

Figure 7:
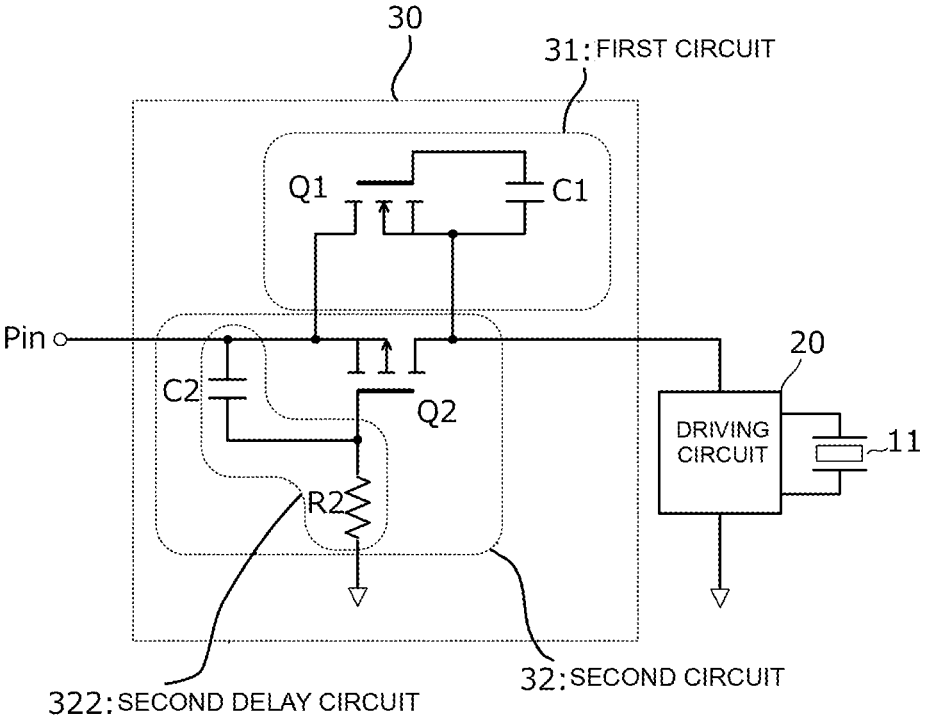
FIG. 7 is a circuit diagram illustrating a specific circuit configuration of the startup circuit 30.

FIG. 7 is a circuit diagram illustrating a specific circuit configuration of the startup circuit 30. The startup circuit 30 includes the first circuit 31 and the second circuit 32. The first circuit 31 is constituted by a first MOS-FET Q1, which is an N-channel MOS-FET, and a capacitor C1. The second circuit 32 is constituted by a second MOS-FET Q2, which is a P-channel MOS-FET, a capacitor C2, and a resistor R2.

Figure 8A:
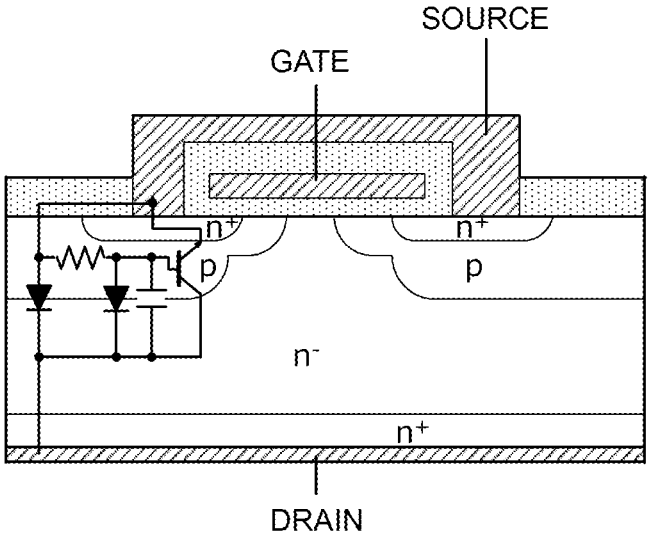
FIG. 8A is a cross-sectional view illustrating the internal structure of a first MOS-FET Q1.
Figure 8B:
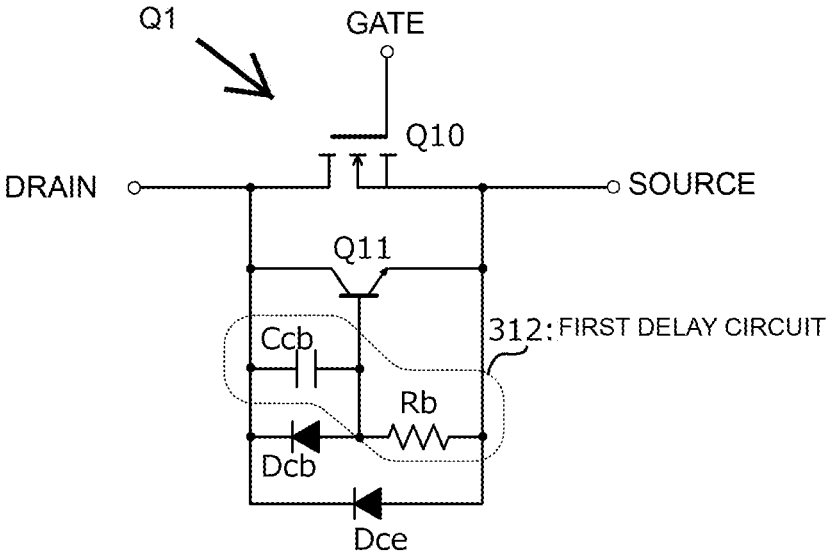
FIG. 8B is the equivalent circuit diagram thereof.

First, the configuration and function of the first MOS-FET Q1 will be described with reference to FIGS. 8A and 8B. FIG. 8A is a cross-sectional view illustrating the internal structure of the first MOS-FET Q1, and FIG. 8B is the equivalent circuit diagram thereof. FIG. 8A also illustrates circuit symbols of individual parasitic elements. In the first MOS-FET Q1, p-type diffusion layers are disposed on an element formation surface (an upper surface in FIG. 8A) of an $n^-$-type wafer, and $n^+$ diffusion layers are disposed in the p-type diffusion layers. An $n^+$ diffusion layer is disposed on an entire surface opposite to the element formation surface of the wafer. A source electrode is disposed in the $n^+$ diffusion layers near the element formation surface. A gate electrode is disposed above a channel formation region, which is a region sandwiched between the $n^+$ diffusion layers in the surface direction, with an insulting film interposed therebetween. A drain electrode is disposed in the $n^+$ diffusion layer on the surface opposite to the element formation surface of the wafer.

In FIG. 8B, a MOS-FET Q10 is an original MOS-FET, and the other circuits are parasitic elements. An NPN transistor Q11 is constituted by, as illustrated in FIG. 8A, the $n^-$-type wafer, the $n^+$ diffusion layers, and the p-type diffusion layer therebetween. A capacitor Ccb is a parasitic capacitance generated between the $n^-$-type wafer and the p-type diffusion layer. A diode Dcb is a parasitic diode generated between the $n^-$-type wafer and the p-type diffusion layer. A resistor Rb is a parasitic resistor formed of the p-type diffusion layer. A diode Dce is a parasitic diode generated between the p-type diffusion layer and the $n^+$ diffusion layer in which the drain electrode is disposed. In FIG. 8B, the capacitor Ccb and the resistor Rb constitute the first delay circuit 312 formed of a CR time constant circuit.

With the first MOS-FET Q1 having the circuit configuration illustrated in FIG. 8B, when a power supply voltage is applied to the power supply voltage input terminal Pin illustrated in FIG. 7, a potential difference sufficient to turn on the NPN transistor is generated at the resistor Rb of the equivalent circuit, a base current flows to the NPN transistor Q11 through the capacitor Ccb, and the NPN transistor Q11 is turned on. The original MOS-FET Q10 remains in an OFF state because the gate-source potential of the MOS-FET Q10 is zero.

Thereafter, the NPN transistor Q11 is turned off when a base-emitter voltage Vbe becomes lower than about 0.6 V as the charging of the capacitor Ccb progresses. Thus, the CR time constant of the first delay circuit 312 determines the period of the first stage P1.

Next, the configuration and function of the second circuit 32 illustrated in FIG. 7 will be described. The second delay circuit 322 is constituted by a CR time constant circuit including the capacitor C2 and the resistor R2. The second MOS-FET Q2 is a P-channel depletion MOS-FET. When a power supply voltage is applied to the power supply voltage input terminal Pin, the gate-source potential of the second MOS-FET Q2 is low and thus the second MOS-FET Q2 remains in an OFF state. Thereafter, the gate potential of the second MOS-FET Q2 decreases as the charging of the capacitor C2 progresses. The second MOS-FET Q2 is turned on when the gate potential of the second MOS-FET Q2 becomes lower than a threshold value. The CR time constant of the second delay circuit 322 determines the period from the start of the startup to the start of the third stage. Thus, the CR time constant of the second delay circuit 322 is larger than the CR time constant of the first delay circuit 312.

The first MOS-FET Q1 illustrated in FIG. 7 is used in an OFF state. Thus, the element connected between the gate and source thereof may be a resistance element instead of the capacitor C1. Alternatively, the gate and source may directly be connected to each other.

Second Embodiment

Figure 9:
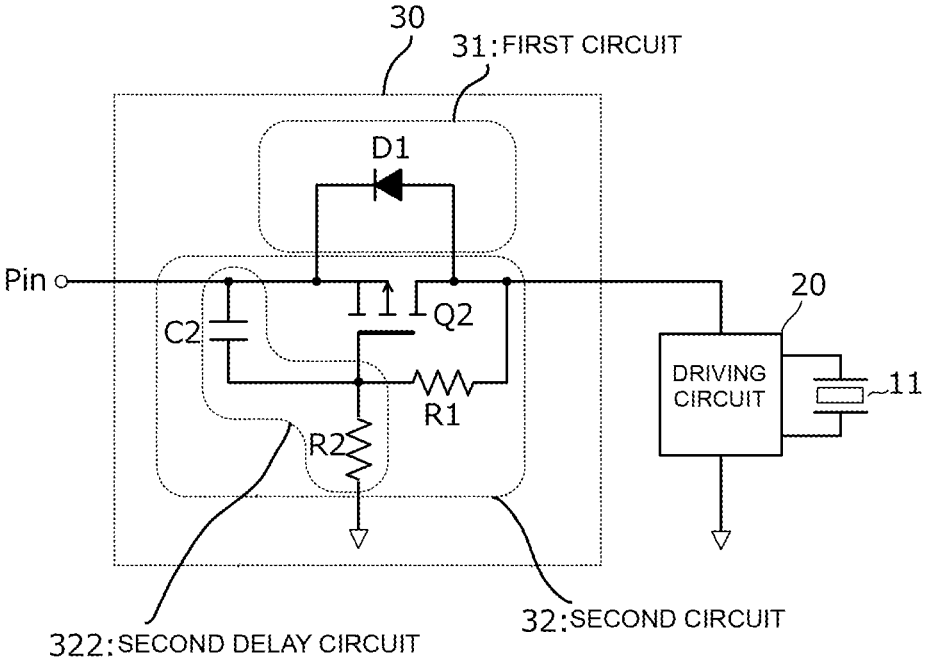
FIG. 9 is a circuit diagram illustrating a specific circuit configuration of the startup circuit 30 of a fluid control device according to a second embodiment.

FIG. 9 is a circuit diagram illustrating a specific circuit configuration of the startup circuit 30 of a fluid control device according to a second embodiment. The startup circuit 30 includes the first circuit 31 and the second circuit 32, and the first circuit 31 is constituted by a diode D1. The second circuit 32 is constituted by the second MOS-FET Q2, which is a P-channel MOS-FET, the capacitor C2, and resistors R2 and R1. The capacitor C2 and the resistor R2 constitute the second delay circuit 322 formed of a CR time constant circuit. The second MOS-FET Q2 is a P-channel depletion MOS-FET.

The resistor R1 constitutes a discharge path of the capacitor C2 while the second MOS-FET Q2 is in an ON state. Thus, even if the power supply voltage inputted to the power supply voltage input terminal Pin is interrupted in a short time, the second delay circuit 322 properly performs a delay operation.

In this example, when a power supply voltage is applied to the power supply voltage input terminal Pin, a reverse current (Zener current) flows through the diode D1 first. Immediately after the application of the power supply voltage to the power supply voltage input terminal Pin, the potential difference between the gate and source of the second MOS-FET Q2 is small and thus the second MOS-FET Q2 keeps an OFF state. Thereafter, the gate potential of the second MOS-FET Q2 decreases as the charging of the capacitor C2 progresses. When the gate potential of the second MOS-FET Q2 becomes lower than the threshold value, the second MOS-FET Q2 is turned on. The drain-source voltage of the second MOS-FET Q2 in an ON state is lower than the Zener voltage of the diode D1, and thus the anode-cathode voltage of the diode D1 decreases below the Zener voltage in response to the turn-on of the second MOS-FET Q2. That is, the diode D1 is turned off.

Figure 10:
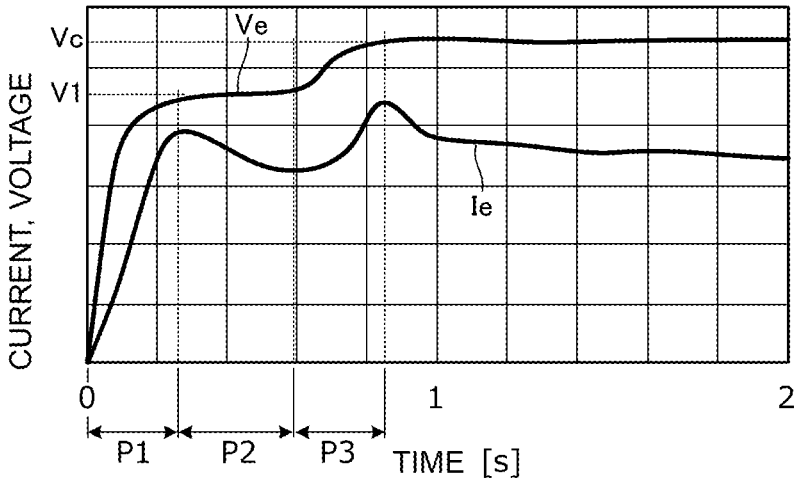
FIG. 10 is a graph illustrating chronological changes in the driving power supply voltage applied to the driving circuit 20 of the fluid control device according to the second embodiment and chronological changes in the current flowing through the driving circuit 20.
Figure 11:
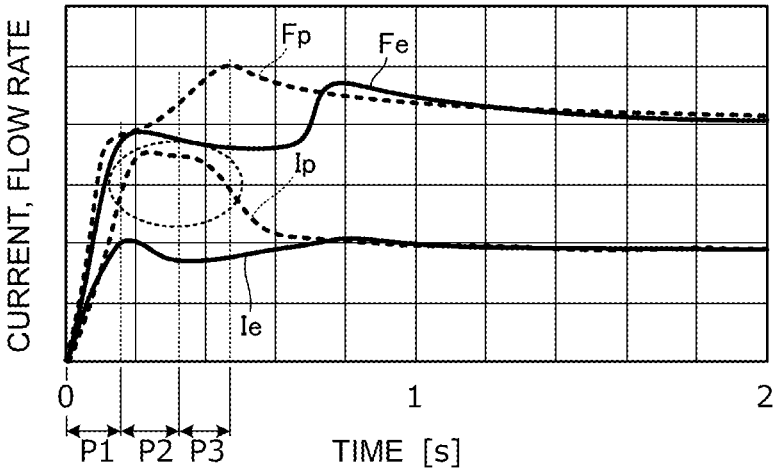
FIG. 11 is a graph illustrating chronological changes in the current flowing through the driving circuit 20 and chronological changes in the flow rate in the fluid control device according to the second embodiment and a fluid control device according to a comparative example.

FIG. 10 is a graph illustrating chronological changes in the driving power supply voltage applied to the driving circuit 20 and chronological changes in the current flowing through the driving circuit 20. FIG. 11 is a graph illustrating chronological changes in the current flowing through the driving circuit 20 and chronological changes in the flow rate in the fluid control device according to the present embodiment and a fluid control device according to a comparative example. The fluid control device according to the comparative example does not include a startup circuit that controls the driving power supply voltage at startup.

In FIG. 10, a waveform Ve represents chronological changes in the driving power supply voltage, and a waveform Ie represents chronological changes in the current flowing through the driving circuit. As illustrated in FIG. 10, the driving power supply voltage increases to the voltage V1 lower than the constant voltage Vc in the first stage P1. The difference between the constant voltage Vc and the voltage V1 corresponds to the Zener voltage of the diode D1. The Zener voltage of the diode D1 is, for example, about 2 V to 3 V. Thereafter, the driving power supply voltage keeps the voltage V1 in the second stage P2 until the second MOS-FET Q2 is turned on. After the second MOS-FET Q2 is turned on, the driving power supply voltage increases to the constant voltage Vc in the third stage P3.

In FIG. 11, a waveform Ie represents chronological changes in the current flowing through the driving circuit 20, and a waveform Ip represents chronological changes in the current flowing through the driving circuit in the fluid control device according to the comparative example. A waveform Fe represents chronological changes in the flow rate of a fluid flowing through the piezoelectric pump 10, and a waveform Fp represents chronological changes in the flow rate of a fluid flowing through a piezoelectric pump in the fluid control device according to the comparative example. As illustrated in FIG. 11, in the fluid control device according to the comparative example, the current peaks after about 0.2 seconds from the start of the startup, and an inrush current flows as enclosed in the broken-line ellipse. On the other hand, in the fluid control device according to the present embodiment, an inrush current does not occur or is sufficiently suppressed. In the fluid control device according to the comparative example, the flow rate peaks after about 0.5 seconds from the start of the startup. In the fluid control device according to the present embodiment, the flow rate peaks after about 0.8 seconds. That is, the timing at which the flow rate peaks is delayed only by 0.3 seconds. Furthermore, the peak value is equivalent to that of the fluid control device according to the comparative example. In the fluid control device according to the present embodiment, the rise in the first stage P1 is equivalent to that in the comparative example, that is, the startup is quickly performed.

In the example illustrated in FIG. 7, the first MOS-FET Q1 is constituted by an N-channel MOS-FET, and the second MOS-FET Q2 is constituted by a P-channel MOS-FET. When the power supply voltage is a negative voltage, for example, the relationship between N-channel and P-channel may be reversed.

In the first and second embodiments, each of the first delay circuit 312 and the second delay circuit 322 is constituted by a CR time constant circuit. Alternatively, each of these delay circuits may be constituted by a digital circuit. In addition, a circuit for supplying a driving power supply voltage to the driving circuit 20 through a switch, and a circuit for controlling the switch by using an output voltage of a microcontroller may be constituted, and the first stage P1, the second stage P2, and the third stage P3 may be formed by control of the microcontroller.

In the above-described example, the second MOS-FET Q2 is constituted by a P-channel depletion MOS-FET. Alternatively, the second MOS-FET Q2 may be an enhancement MOS-FET or a junction MOS-FET.

Third Embodiment

Figure 12A:
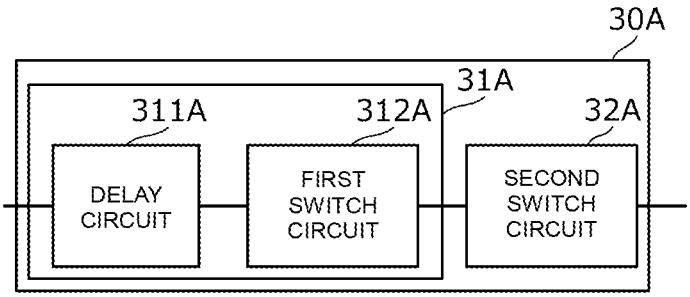
FIG. 12A illustrates functional blocks of a startup circuit of a fluid control device according to a third embodiment.
Figure 12B:
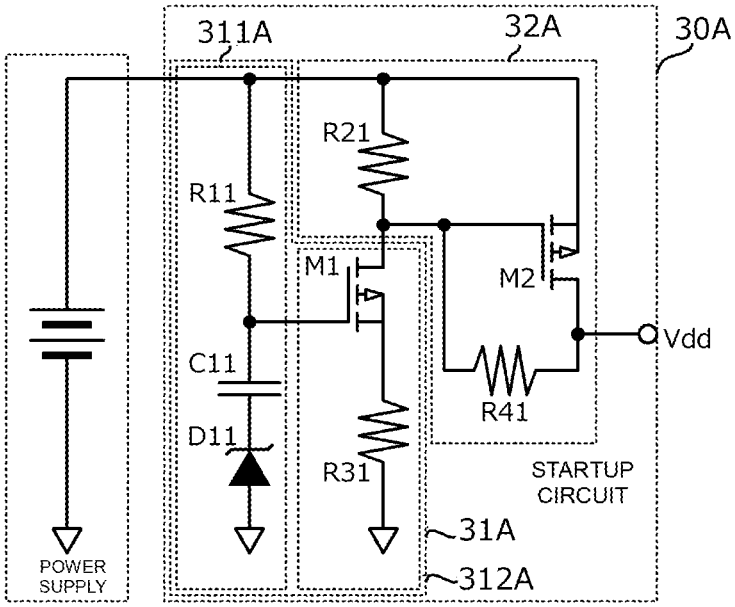
FIG. 12B is a circuit diagram of the startup circuit.

FIG. 12A illustrates functional blocks of a startup circuit of a fluid control device according to a third embodiment, and FIG. 12B is a circuit diagram of the startup circuit. The fluid control device according to the third embodiment is different from the fluid control device 101 according to the first embodiment in that the startup circuit 30 is replaced with a startup circuit 30A.

As illustrated in FIG. 12A, the startup circuit 30A includes a delay circuit 311A, a first switch circuit 312A, and a second switch circuit 32A. The delay circuit 311A and the first switch circuit 312A constitute a first circuit 31A. The delay circuit 311A, the first switch circuit 312A, and the second switch circuit 32A are connected in this order from the power supply side, and the output terminal of the second switch circuit 32A is connected to the driving circuit 20.

The delay circuit 311A delays the operation start time of the first switch circuit 312A with respect to the startup start time.

The first switch circuit 312A generates a voltage for adjusting the output voltage of the second switch circuit 32A.

The second switch circuit 32A outputs an initial voltage Vddp lower than the power supply voltage in an initial state (at the start of the startup). The second switch circuit 32A gradually increases the output voltage from the initial voltage Vddp during a period over which the output voltage is controlled by the first switch circuit 312A. When the control to maximize an output is performed by the first switch circuit 312A, the second switch circuit 32A outputs a constant-operation driving power supply voltage Vddo to the driving circuit 20.

Figure 13:
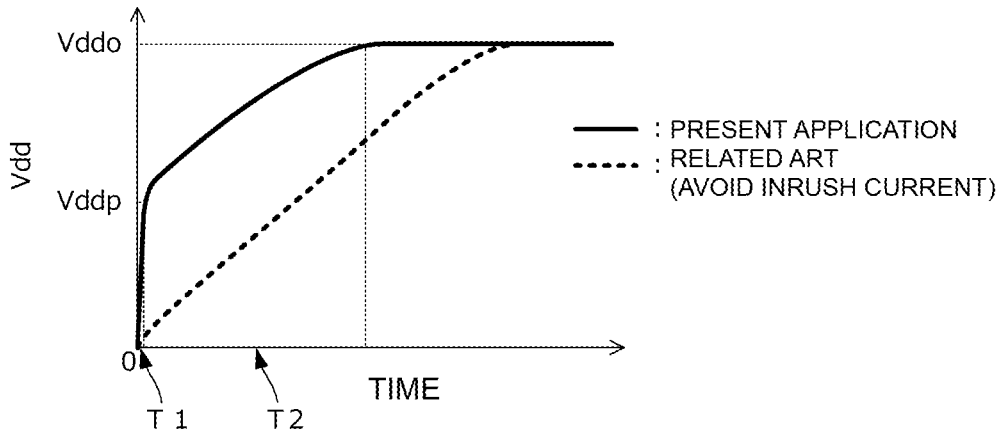
FIG. 13 is a graph illustrating chronological changes in the driving voltage supplied to the driving circuit according to the third embodiment.

With this configuration, the startup circuit 30A is capable of producing a driving power supply voltage having the time characteristic illustrated in FIG. 13.

When the startup circuit 30A is constituted by an analog circuit, the configuration illustrated in FIG. 12B may be used, for example. As illustrated in FIG. 12B, the startup circuit 30A is connected to the power supply, and applies the driving power supply voltage Vdd to the driving circuit 20 as in the first embodiment. The startup circuit 30A includes resistance elements R11, R21, R31, and R41, a capacitor C11, a diode D11, and FETs M1 and M2. The FETs M1 and M2 are p-type FETs.

The first terminal of the resistance element R11 is connected to the positive pole of the power supply. The negative pole of the power supply is grounded to a reference potential. The second terminal of the resistance element R11 is connected to the first terminal of the capacitor C11, and the second terminal of the capacitor C11 is connected to the cathode of the diode D11. The anode of the diode D11 is grounded.

The gate terminal of the FET M1 is connected to the connection line between the resistance element R11 and the capacitor C11.

The first terminal of the resistance element R21 is connected to the positive pole of the power supply. The second terminal of the resistance element R21 is connected to the drain terminal of the FET M1. The source terminal of the FET M1 is connected to the first terminal of the resistance element R31, and the second terminal of the resistance element R31 is grounded.

The gate terminal of the FET M2 is connected to the resistance element R21, the drain terminal of the FET M1, and the second terminal of the resistance element R41.

The source terminal of the FET M2 is connected to the positive pole of the power supply. The drain terminal of the FET M2 is connected to the first terminal of the resistance element R41, and the second terminal of the resistance element R41 is connected to the second terminal of the resistance element R21.

The output terminal for the driving power supply voltage Vdd of the driving circuit 20 is connected to the drain terminal of the FET M2 and is at the same potential as the potential of the drain terminal.

When a power supply voltage is applied from the power supply in this circuit configuration, the driving power supply voltage Vdd changes through the following states in order.

FIG. 13 is a graph illustrating chronological changes in the driving power supply voltage that is applied to the driving circuit according to the third embodiment.

(First Voltage Rise Period)

Upon application of a power supply voltage to the startup circuit 30A being started, the charging of the capacitor C11 is started. The initial voltage Vddp of the driving power supply voltage Vdd is determined by voltage division between the resistance elements R21 and R41 and the driving circuit 20.

Thus, the initial voltage Vddp is set to a value lower than the constant-operation driving power supply voltage (the desired final driving power supply voltage) Vddo, and the voltage division ratio between the resistance elements R21 and R41 and the driving circuit 20 is set to obtain the initial voltage Vddp. For example, when the constant-operation driving power supply voltage Vddo is about 16.5 V, the initial voltage Vddp is set to about 4.5 V. That is, the initial voltage Vddp is set by using the voltage division ratio between the resistance elements R21 and R41 when the FET M2 is in an OFF state and the driving circuit 20.

Accordingly, as illustrated in FIG. 13, the driving power supply voltage Vdd increases to the initial voltage Vddp lower than the constant-operation driving power supply voltage Vddo in a very short period T1. This makes it possible to prevent a situation from occurring where the driving power supply voltage Vdd suddenly reaches the constant-operation driving power supply voltage Vddo, and to suppress an inrush current. The driving power supply voltage Vdd increases to a predetermined voltage (initial voltage Vddp) faster than in the case of gradually increasing the driving power supply voltage in the manner represented by the broken line in FIG. 13, by using a configuration for avoiding inrush current according to the related art.

When the charging of the capacitor C11 continues during the period T1, the gate voltage of the FET M1 increases in accordance with a time constant that is based on the element values of the resistance element R11, the capacitor C11, and the diode D11.

(Second Voltage Rise Period)

When the gate voltage of the FET M1 increases to exceed the threshold value relative to the source voltage of the FET M1, the FET M1 starts conducting. Accordingly, the gate voltage of the FET M2 gradually decreases. That is, the unsaturated region of the FET M1 is used to gradually decrease the gate voltage of the FET M2.

The decrease in the gate voltage of the FET M2 makes the gate-source voltage of the FET M2 negative. Thus, when the gate voltage of the FET M2 gradually decreases, the voltage drop between the drain and source of the FET M2 gradually decreases. That is, the unsaturated region of the FET M2 is used to gradually increase the drain-source voltage of the FET M2.

Accordingly, the driving power supply voltage Vdd is determined by the voltage division ratio between the driving circuit 20 and the amount of voltage drop in the series-parallel combined resistance of the FET M2 and the resistance elements R21 and R41. Thus, as in the period T2 in FIG. 13, the driving power supply voltage Vdd gradually increases from the initial voltage Vddp and reaches the constant-operation driving power supply voltage Vddo to converge.

In this way, an inrush current can be avoided by using the circuit configuration according to the present embodiment. Furthermore, the constant-operation driving power supply voltage Vddo can be quickly applied to the piezoelectric element. That is, the startup time of the piezoelectric pump can be shortened. Furthermore, the use of the circuit configuration according to the present embodiment eliminates the necessity for using the startup circuit described in the foregoing embodiments and simplifies the configuration of a fluid control device.

In the above description, a p-type FET is used, but another type of semiconductor element may be used.

Fourth Embodiment

Figure 14A:
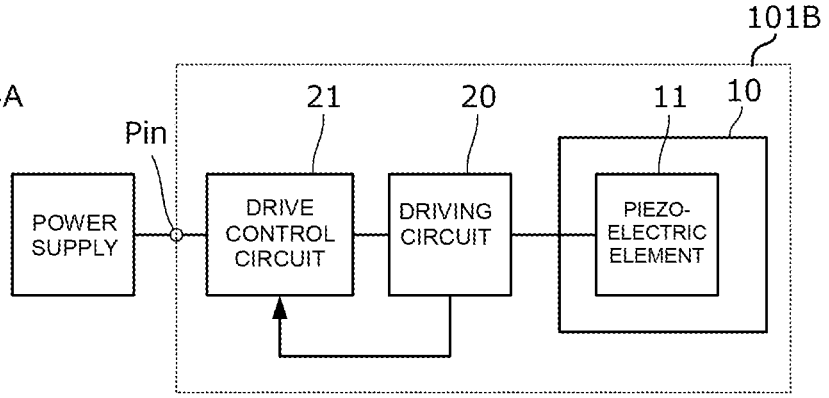
FIG. 14A is a block diagram illustrating the configuration of a fluid control device according to a fourth embodiment.
Figure 14B:
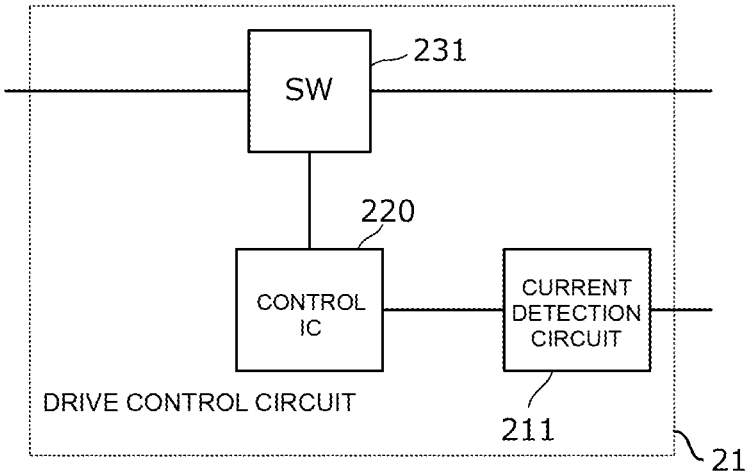
FIG. 14B is a block diagram illustrating the configuration of a drive control circuit.

FIG. 14A is a block diagram illustrating the configuration of a fluid control device according to a fourth embodiment, and FIG. 14B is a block diagram illustrating the configuration of a drive control circuit. A fluid control device 101B according to the fourth embodiment is different from the fluid control device 101 according to the first embodiment in that the startup circuit 30 is not included but a drive control circuit 21 is included. Except for this, the configuration of the fluid control device 101B is similar to that of the fluid control device 101, and the description of similar parts will not be given.

The drive control circuit 21 is connected between the power supply voltage input terminal Pin and the driving circuit 20. Roughly, the drive control circuit 21 detects a current to be applied to the piezoelectric element 11 and controls a driving power supply voltage so that the back pressure to be used for aspiration does not exceed a back pressure threshold value or so that the amplitude of the piezoelectric element 11 does not exceed an amplitude threshold value.

Figure 15A:
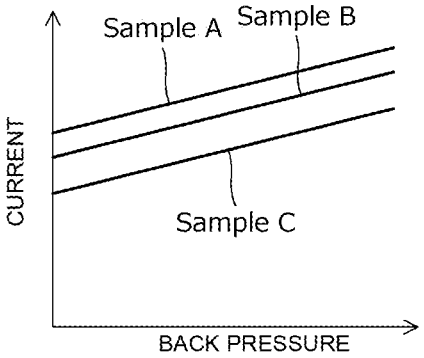
FIG. 15A is a graph illustrating the relationship between the back pressure of a piezoelectric pump and the current flowing through the piezoelectric pump.
Figure 15B:
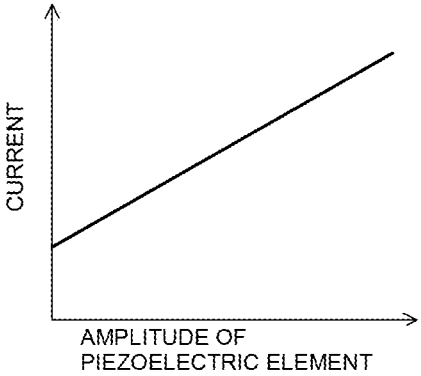
FIG. 15B is a graph illustrating the relationship between the amplitude of a piezoelectric element and the current.

To realize this, the drive control circuit 21 controls the driving power supply voltage on the basis of the concept illustrated in FIGS. 15A and 15B. FIG. 15A is a graph illustrating the relationship between the back pressure of the piezoelectric pump and the current flowing through the piezoelectric pump, and FIG. 15B is a graph illustrating the relationship between the amplitude of the piezoelectric element and the current.

As illustrated in FIG. 15A, the back pressure and the current value have a linear relationship, that is, the current value increases as the back pressure increases. In this case, the linearity between the back pressure and the current value is maintained although there is an individual difference between piezoelectric elements.

As illustrated in FIG. 15B, the amplitude of the piezoelectric element and the current value have a linear relationship, that is, the current value increases as the amplitude of the piezoelectric element increases.

Thus, the back pressure and the amplitude of the piezoelectric element 11 can be observed by observing the current value to be applied to the piezoelectric element 11.

Specifically, as illustrated in FIG. 14B, the drive control circuit 21 includes a current detection circuit 211, a control IC 220, and a switch 231.

The switch 231 is connected between the power supply voltage input terminal Pin and the driving circuit 20. The switch 231 selectively connects or disconnects the power supply voltage input terminal Pin and the driving circuit 20 under the control by the control IC 220.

The current detection circuit 211 detects the driving current of the driving circuit 20, that is, the current to be applied to the piezoelectric element 11, and outputs a detection signal to the control IC 220.

Figure 16:
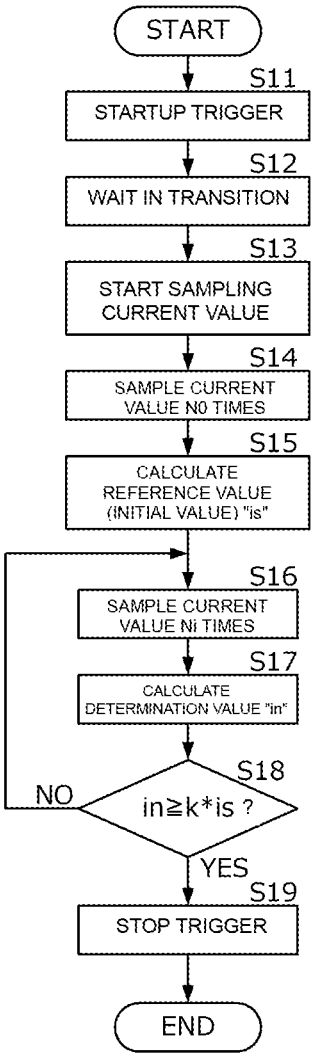
FIG. 16 is a diagram illustrating a first mode of the flowchart of the drive control performed by the drive control circuit according to the fourth embodiment.

The control IC 220 performs the process illustrated in FIG. 16. FIG. 16 is a diagram illustrating a first mode of the flowchart of the drive control performed by the drive control circuit according to the fourth embodiment.

As a startup starting operation, the control IC 220 generates a startup trigger (S11) to turn on the switch. After a wait in transition (S12), the control IC 220 starts sampling a current value (S13). For example, as the wait in transition, the control IC 220 does not obtain a current detection value for about 0.2 seconds. Accordingly, the noise caused by an inrush current at startup or the like can be eliminated.

The control IC 220 consecutively samples a current value N0 times (S14). N0 is a desired integer, may appropriately be determined, and is 200, for example. The sampling interval may appropriately be determined, preferably is as short as possible, and is, for example, shorter than the period of the wait in transition.

The control IC 220 calculates a reference value (initial value) "is" from the N0 current values (S15). For example, the control IC 220 calculates an average of the N0 current values as the reference value "is".

The control IC 220 continues sampling a current value, and then consecutively samples a current value Ni times (S16). Ni is a desired integer, may appropriately be determined, and is equal to N0, for example. The sampling interval may appropriately be determined, and is, for example, the same as in the case of N0.

The control IC 220 calculates a determination value "in" from the Ni current values (S17). For example, the control IC 220 calculates an average of the Ni current values as the determination value "in".

The control IC 220 compares the determination value "in" with the reference value "is". Specifically, the control IC 220 calculates a current threshold value from the reference value "is". For example, the control IC 220 calculates the current threshold value from "k*is", in which k is a real number larger than 1, for example, 1.5. The current threshold value is set on the basis of the above-described amplitude threshold value or the back pressure threshold value.

If the determination value "in" is larger than or equal to the current threshold value "k*is" (YES in S18), the control IC 220 generates a stop trigger for the switch 231 (S19). Accordingly, the switch 231 is opened, and the supply of the driving power supply voltage to the driving circuit 20 is stopped.

On the other hand, if the determination value "in" is smaller than the current threshold value "k*is" (NO in S18), the control IC 220 consecutively samples a current value Ni times again (S16).

The above-described process makes it possible to prevent a situation from occurring where the back pressure exceeds the back pressure threshold value and the amplitude of the piezoelectric element 11 exceeds the amplitude threshold value. Accordingly, in the case of a back pressure, the excessive inhalation can be prevented, and the damage to the mucous membranes or the skin surface caused by nasal mucus aspiration or a milker, or a negative influence on an affected part in NPWT can be prevented. Furthermore, it is not necessary to use a pressure sensor. By using the comparison with the reference value (initial value), a stop process can be performed without being affected by an error in each device.

In the process illustrated in FIG. 16, if the determination value "in" is larger than or equal to the current threshold value "k*is", the supply of the driving power supply voltage is stopped and the process is finished. However, by performing the process illustrated in FIG. 17, the driving can be continued within an appropriate current range even if the supply of the driving power supply voltage is once stopped.

Figure 17:
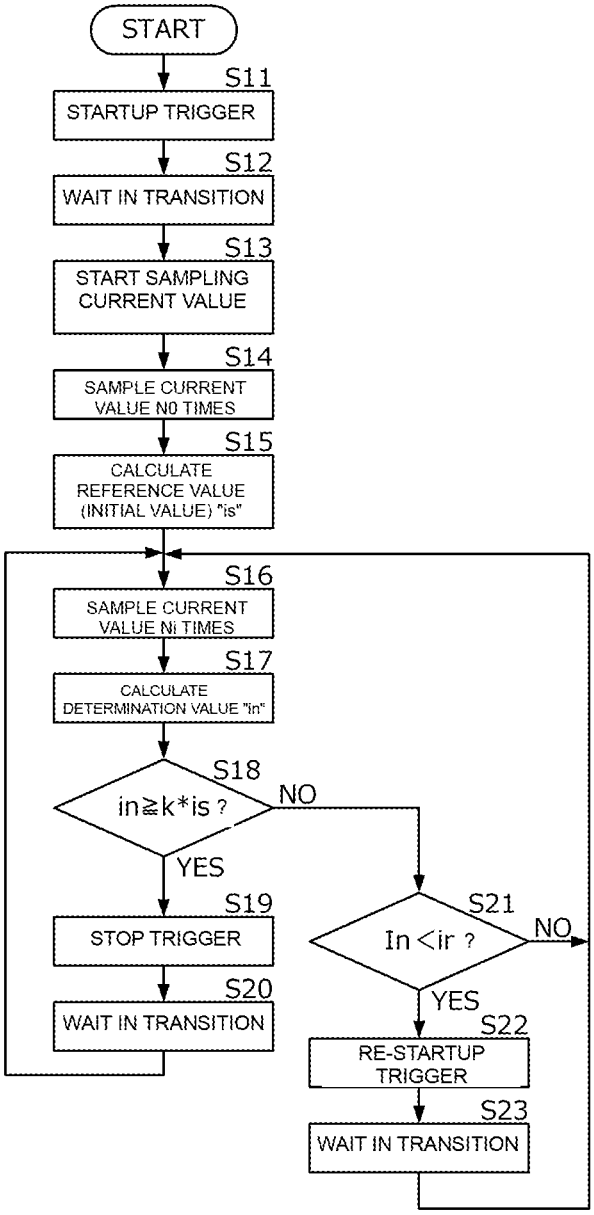
FIG. 17 is a diagram illustrating a second mode of the flowchart of the drive control performed by the drive control circuit according to the fourth embodiment.

FIG. 17 is a diagram illustrating a second mode of the flowchart of the drive control performed by the drive control circuit according to the fourth embodiment.

Steps S11 to S19 illustrated in FIG. 17 are the same as steps S11 to S19 illustrated in FIG. 16, and thus the description thereof will not be given.

After generating a stop trigger (S19), the control IC 220 waits in transition (S20). This wait-in-transition state enables the back pressure to be decreased or the amplitude to be attenuated. After the wait in transition, the control IC 220 consecutively samples a current value Ni times again (S16).

If the determination value "in" is smaller than the current threshold value "k*is" (NO in S18), the control IC 220 determines whether or not the determination value "in" is smaller than a lower limit threshold value "ir". The lower limit threshold value "ir" is set on the basis of the lower limit value of the back pressure or the amplitude of the piezoelectric element required for the device.

If the determination value "in" is larger than or equal to the lower limit threshold value "ir" (NO in S21), the control IC 220 consecutively samples a current value Ni times again (S16).

If the determination value "in" is smaller than the lower limit threshold value "ir" (YES in S21), the control IC 220 generates a re-startup trigger (S22). Accordingly, the switch 231 is closed again, and the supply of the driving power supply voltage to the driving circuit 20 is restarted.

After generating the re-startup trigger, the control IC 220 waits in transition (S23), and then consecutively samples a current value Ni times again (S16). With this transition state, the noise caused by an inrush current at re-startup or the like can be eliminated.

With this configuration and process, the above-described negative influence on an affected part can be prevented and the following effects can be obtained. The piezoelectric pump can be continuously driven within an appropriate voltage range (current range). Accordingly, wasteful aspiration does not occur and power can be saved. Furthermore, in nasal mucus aspiration or a milker, a nozzle is temporarily separated from the skin, and thus efficient aspiration can be performed.

Fifth Embodiment

Figure 18:
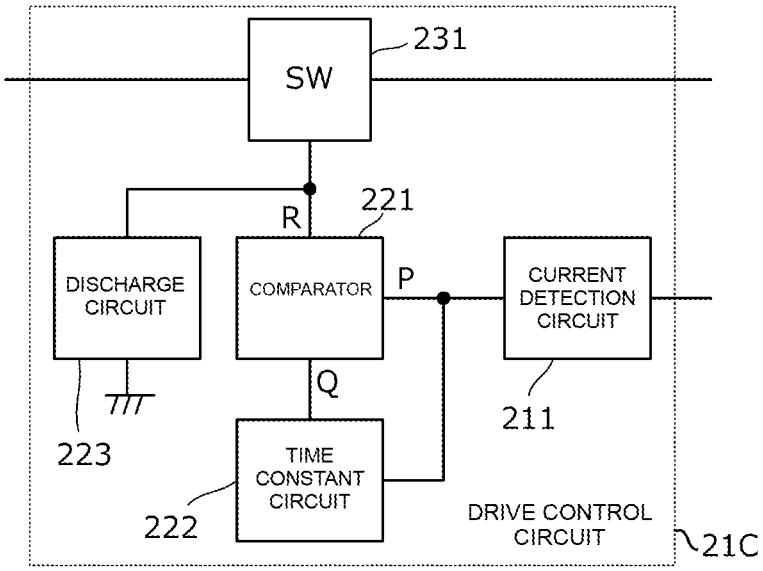
FIG. 18 is a block diagram illustrating the configuration of a drive control circuit of a fluid control device according to a fifth embodiment.

FIG. 18 is a block diagram illustrating the configuration of a drive control circuit of a fluid control device according to a fifth embodiment. The fluid control device according to the fifth embodiment is different from the fluid control device 101B according to the fourth embodiment in the configuration of a drive control circuit 21C. Except for this, the configuration of the fluid control device according to the fifth embodiment is similar to that of the fluid control device 101B, and the description of similar parts will not be given.

As illustrated in FIG. 18, the drive control circuit 21C includes the current detection circuit 211, a comparator 221, a time constant circuit 222, a discharge circuit 223, and the switch 231.

The switch 231 is connected between the power supply voltage input terminal Pin and the driving circuit 20. The switch 231 selectively connects or disconnects the power supply voltage input terminal Pin and the driving circuit 20 under the control by the control IC 220.

The current detection circuit 211 detects the driving current of the driving circuit 20, that is, the current to be applied to the piezoelectric element 11, and outputs a detection signal P to the comparator 221 and the time constant circuit 222. The signal level of the detection signal P depends on a detected current value.

The time constant circuit 222 performs a delay process on the detection signal P and outputs a delay signal Q to the comparator 221.

The comparator 221 compares the signal level of the detection signal P with the signal level of the delay signal Q. If the comparator 221 detects that the signal level of the delay signal Q is higher than or equal to the signal level of the detection signal P, the comparator 221 generates a control signal R for a stop trigger. The comparator 221 outputs the control signal R for a stop trigger to the switch 231. In response to receipt of the control signal R for a stop trigger, the switch 231 disconnects the power supply voltage input terminal Pin and the driving circuit 20.

The discharge circuit 223 is, for example, a switch for discharge, and controls the connection and disconnection between the signal output line from the comparator 221 to the switch 231 and the ground potential. The discharge circuit 223 comes into conduction after a predetermined period of time after the control signal R for a stop trigger is generated. Accordingly, the control signal R for a stop trigger is not supplied to the switch 231, and the switch 231 enters an ON state again.

With this configuration, driving voltage control similar to that in the fluid control device 101B according to the above-described fourth embodiment can be performed.

Figure 19:
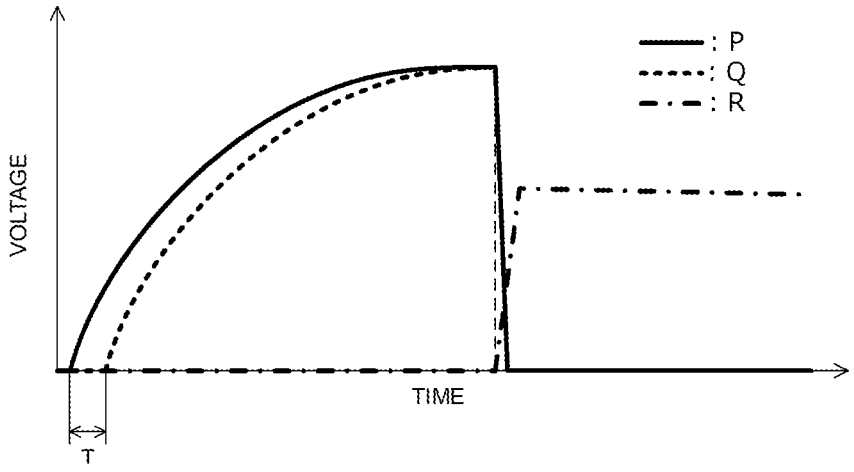
FIG. 19 is a graph illustrating chronological changes in individual signal levels in the drive control circuit of the fluid control device according to the fifth embodiment.

FIG. 19 is a graph illustrating chronological changes in individual signal levels in the drive control circuit of the fluid control device according to the fifth embodiment.

As illustrated in FIG. 19, the signal level of the detection signal P increases when the startup starts. The signal level of the delay signal Q increases similarly to the detection signal P with a delay time $\tau$ that is determined by the time constant of the time constant circuit 222. The signal levels of the detection signal P and the delay signal Q change to converge as the pressure increases in accordance with the specifications of the piezoelectric pump. Thus, after the predetermined period of time, the signal level of the delay signal Q matches the signal level of the detection signal P. With reference to the timing of the match, the control signal R for a stop trigger is generated.

Here, the delay time (time constant) of the time constant circuit 222 is determined on the basis of the above-described back pressure threshold value and amplitude the threshold value. Accordingly, the driving power supply voltage can be controlled so that the back pressure does not exceed the back pressure threshold value or so that the amplitude of the piezoelectric element 11 does not exceed the amplitude threshold value.

In addition, with the use of the configuration according to the present embodiment, the driving power supply voltage can be controlled without using a control IC.

Sixth Embodiment

Figure 20A:
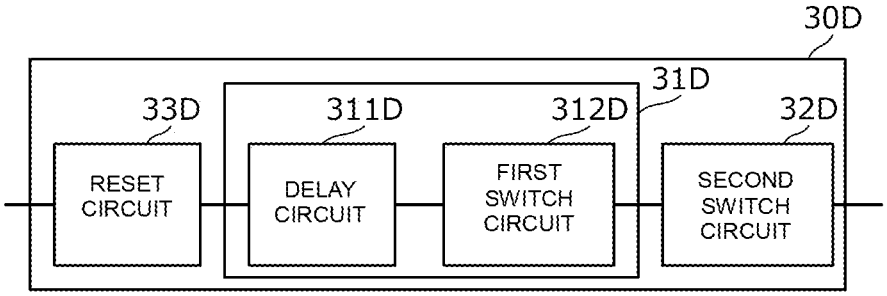
FIG. 20A illustrates functional blocks of a startup circuit of a fluid control device according to a sixth embodiment.
Figure 20B:
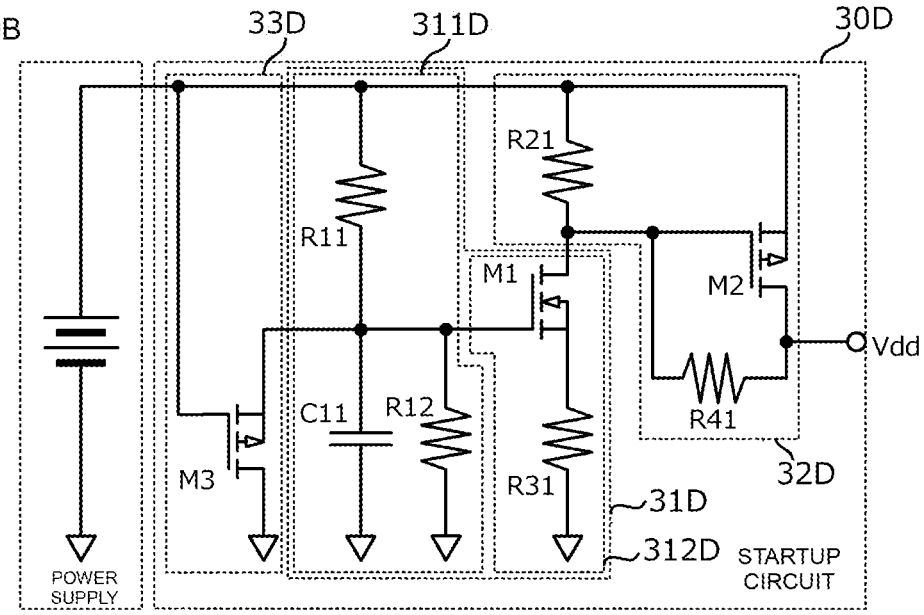
FIG. 20B is a circuit diagram of the startup circuit.

FIG. 20A illustrates functional blocks of a startup circuit of a fluid control device according to a sixth embodiment, and FIG. 20B is a circuit diagram of the startup circuit. The fluid control device according to the sixth embodiment is different from the fluid control device according to the third embodiment in that the startup circuit 30A is replaced with a startup circuit 30D.

As illustrated in FIG. 20A, the startup circuit 30D is different from the startup circuit 30A in that, in terms of functional blocks, a reset circuit 33D is included. Except for this, the configuration of the startup circuit 30D is similar to that of the startup circuit 30A, and the description of similar parts will not be given.

The reset circuit 33D initializes the operations of a delay circuit 311D and the circuits subsequent thereto.

When the startup circuit 30D including the reset circuit 33D is constituted by an analog circuit, for example, the configuration illustrated in FIG. 20B including a FET M3 in addition to the circuit configuration of the startup circuit 30A illustrated in FIG. 12B is used. As illustrated in FIG. 20B, the startup circuit 30D does not include the diode D11.

The FET M3 is a p-type FET. The gate of the FET M3 is connected to the resistance element R11. The source of the FET M3 is connected to the resistance element R12 and the first terminal of the capacitor C11. The drain of the FET M3 is connected to the reference potential.

In this configuration, when the power supply is in an ON state, the voltage of the gate with respect to the source is positive (0 V or more) in the FET M3. At this time, the FET M3 is in a so-called open state, and no current flows between the drain and source of the FET M3.

Thereafter, when the power supply enters an OFF state with the capacitor C11 being charged, the voltage of the gate with respect to the source becomes negative (less than 0 V) in the FET M3. At this time, the FET M3 is in a so-called conduction state, and a current flows between the drain and source. Accordingly, the capacitor C11 discharges through the FET M3, and the startup circuit 30D is reset to the initial state (a state to start supplying a driving power supply voltage in which the capacitor C11 is not charged).

In this way, in the startup circuit 30D, the FET M3 constitutes the reset circuit 33D. In this configuration, a reset circuit is formed using only one FET M3 and only one resistance element R11, and thus the configuration of the startup circuit 30D can be simplified. The resistance element R12 is an element for defining the rated voltage of the FET M3 and may be omitted in accordance with the relationship with the voltage of the power supply.

In this way, in the startup circuit 30D, the FET M3 constitutes the reset circuit 33D. In this configuration, a reset circuit is formed using only one FET M3, and thus the configuration of the startup circuit 30D can be simplified.

Figure 21A:
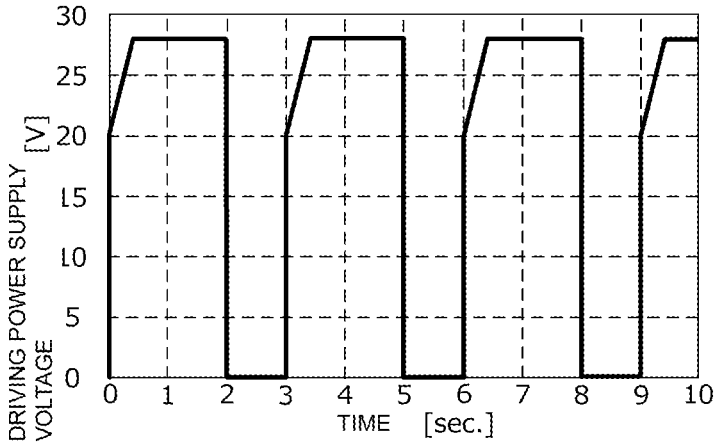
FIG. 21A is a graph illustrating the waveform of a driving power supply voltage when a reset circuit according to the sixth embodiment of the present disclosure is used.
Figure 21B:
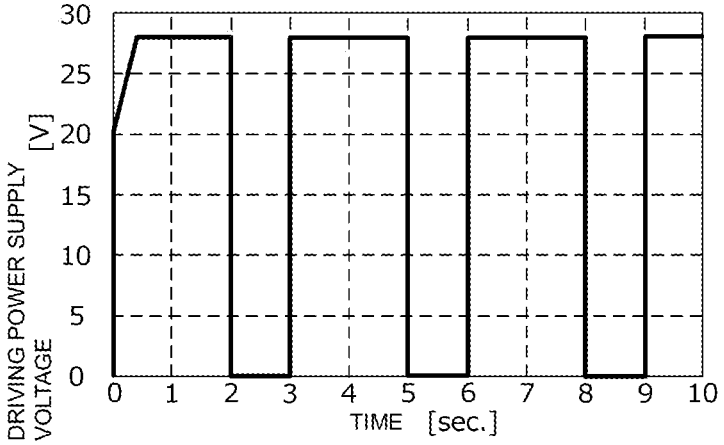
FIG. 21B is a graph illustrating chronological changes in the driving power supply voltage when the reset circuit is not used.

FIG. 21A is a graph illustrating the waveform of a driving power supply voltage when the reset circuit according to the sixth embodiment of the present disclosure is used, and FIG. 21B is a graph illustrating chronological changes in the driving power supply voltage when the reset circuit is not used. In FIGS. 21A and 21B, the horizontal axis represents time, and the vertical axis represents driving power supply voltage.

As illustrated in FIG. 21A, in the configuration including the reset circuit 33D according to the sixth embodiment, the rising waveform of the driving power supply voltage hardly changes even when a startup process is repeatedly performed. On the other hand, in the configuration not including the reset circuit as illustrated in FIG. 21B, the rising waveform of the driving power supply voltage is gradual only in the first time, and is not gradual thereafter.

In this way, the reset circuit 33D makes it possible to reliably repeat the above-described process of gradually increasing the driving power supply voltage. Thus, when control is performed to repeat startup, the occurrence of the above-described problem can be suppressed at each startup.

Seventh Embodiment

Figure 22:
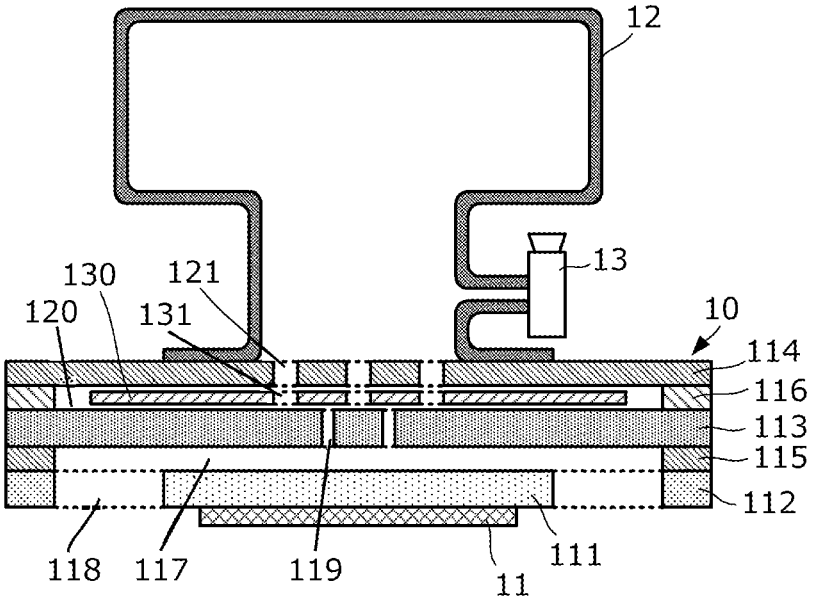
FIG. 22 is a side cross-sectional view illustrating a schematic configuration of a fluid control device according to a seventh embodiment of the present disclosure.

FIG. 22 is a side cross-sectional view illustrating a schematic configuration of a fluid control device according to a seventh embodiment of the present disclosure.

As illustrated in FIG. 22, the fluid control device includes the piezoelectric pump 10, a pressure vessel 12, and an on-off valve 13. As the driving circuit for supplying a driving power supply voltage to the piezoelectric pump 10, the drive control circuit, and the power supply, those described in the above-described embodiments may be applied.

The piezoelectric pump 10 includes the piezoelectric element 11, a diaphragm 111, a supporting body 112, a top plate 113, an outer plate 114, a frame body 115, a frame body 116, and a valve 130.

An outer edge of the diaphragm 111 is supported by the supporting body 112. Here, the diaphragm 111 is supported so as to be able to vibrate in a direction orthogonal to the main surface thereof. There is a gap 118 between the diaphragm 111 and the supporting body 112.

The piezoelectric element 11 is disposed on one main surface of the diaphragm 111.

The top plate 113 is disposed so as to overlap with the diaphragm 111 and the supporting body 112 in plan view. The top plate 113 is separated from the diaphragm 111 and the supporting body 112. A through-hole 119 is disposed in a substantially center region of the top plate 113 in plan view.

The frame body 115 is tubular and is sandwiched between and bonded to the supporting body 112 and the top plate 113.

Accordingly, a pump chamber 117, which is a space surrounded by the diaphragm 111, the supporting body 112, the top plate 113, and the frame body 115, is formed. The pump chamber 117 communicates with the gap 118 and the through-hole 119.

The outer plate 114 is disposed across the top plate 113 from the diaphragm 111. The outer plate 114 is disposed so as to overlap with the top plate 113 in plan view. The outer plate 114 is separated from the top plate 113. A through-hole 121 is disposed in a substantially center region of the outer plate 114 in plan view. The through-hole 121 is disposed at a position different from the through-hole 119 in plan view.

The frame body 116 is tubular and is sandwiched between and bonded to the top plate 113 and the outer plate 114.

Accordingly, a valve chamber 120, which is a space surrounded by the top plate 113, the outer plate 114, and the frame body 116, is formed. The valve chamber 120 communicates with the through-hole 119 and the through-hole 121.

The pressure vessel 12 is disposed so as to cover the through-hole 121 from the outer side of the outer plate 114. The on-off valve 13 is disposed in a flow path between the through-hole 121 and the pressure vessel 12.

The valve 130 is made of a flexible material. The valve 130 has a through-hole 131. The valve 130 is disposed in the valve chamber 120. The valve 130 is disposed such that the through-hole 131 overlaps with the through-hole 121 but does not overlap with the through-hole 119 in plan view.

With this configuration, in the piezoelectric pump 10, the piezoelectric element 11 is driven to vibrate the diaphragm 111, and the pump chamber 117 alternates between a state where the pressure is higher than an external pressure and a state where the pressure is lower than the external pressure.

When the pump chamber 117 comes into a low-pressure state, the air flows into the pump chamber 117 from the outside through the gap 118. On the other hand, when the pump chamber 117 comes into a high-pressure state, the air flows out to the valve chamber 120 through the through-hole 119.

In response to the air flow through the through-hole 119, the valve 130 vibrates toward the outer plate 114, and the through-hole 131 of the valve 130 overlaps with the through-hole 121 of the outer plate 114. Accordingly, the air in the valve chamber 120 flows into the pressure vessel 12 through the through-hole 131 and the through-hole 121. At this time, the control to close the on-off valve 13 causes the air in the valve chamber 120 to flow into the pressure vessel 12 without leaking to the outside.

On the other hand, when the air flows into the pressure vessel 12 to increase the pressure therein, the air flows back from the pressure vessel 12 toward the valve chamber 120 through the through-hole 121. However, when the air flows in through the through-hole 121, the valve 130 vibrates toward the top plate 113 to block the through-hole 119.

Accordingly, the piezoelectric pump 10 is capable of causing the air to flow into the pressure vessel 12 in one direction and preventing a backflow. While the piezoelectric pump 10 is operating and until the control to open the on-off valve 13 is performed, the pressure inside the pressure vessel 12 increases, and a differential pressure increases. The differential pressure is the absolute value of the difference between an outlet-side pressure and an inlet-side pressure. In this case, the outlet-side pressure is equal to or higher than the inlet-side pressure, and thus the differential pressure is the difference between the outlet-side pressure and the inlet-side pressure based on the inlet-side pressure. On the other hand, when control to open the on-off valve 13 is performed, the air flown into the pressure vessel 12 is discharged to the outside. Accordingly, the pressure inside the pressure vessel 12 decreases, and the differential pressure becomes zero.

In the mode illustrated in FIG. 22, the on-off valve 13 is disposed in the flow path that connects the piezoelectric pump 10 and the pressure vessel 12. Alternatively, the on-off valve 13 may be disposed at a position different from the flow path connected to the piezoelectric pump 10 in the pressure vessel 12.

Figure 23A:
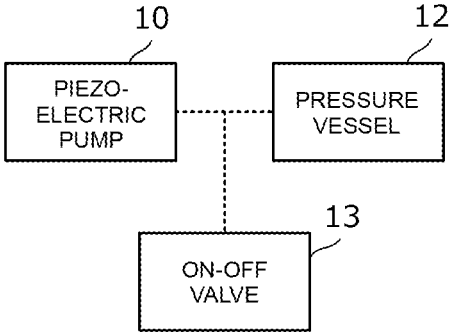
FIGS. 23A and 23B are block diagrams illustrating the positional relationships among a piezoelectric pump, a pressure vessel, and an on-off valve.
Figure 23B:
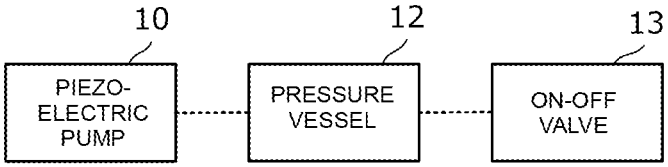

FIGS. 23A and 23B are block diagrams illustrating the positional relationships among the piezoelectric pump, the pressure vessel, and the on-off valve.

The configuration illustrated in FIG. 23A corresponds to the above-described connection mode illustrated in FIG. 22, where the on-off valve 13 is disposed in the flow path that connects the piezoelectric pump 10 and the pressure vessel 12. In the configuration illustrated in FIG. 23B, the on-off valve 13 is disposed at a position different from the flow path connected to the piezoelectric pump 10 in the pressure vessel 12.

Figure 24A:
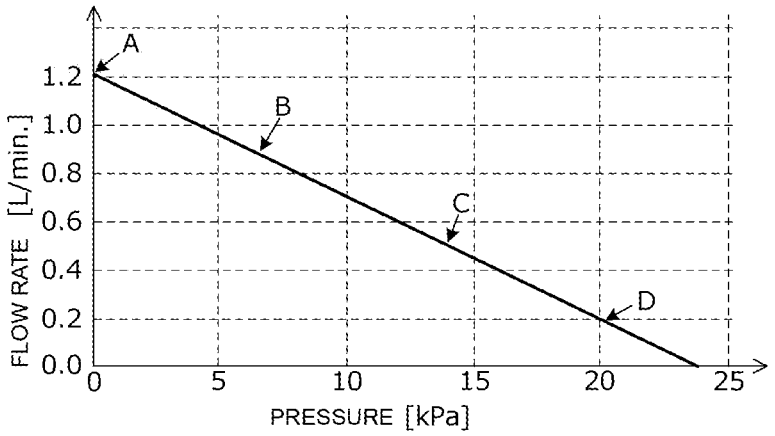
FIG. 24A is a graph illustrating the relationship between the pressure and the flow rate.
Figure 24B:
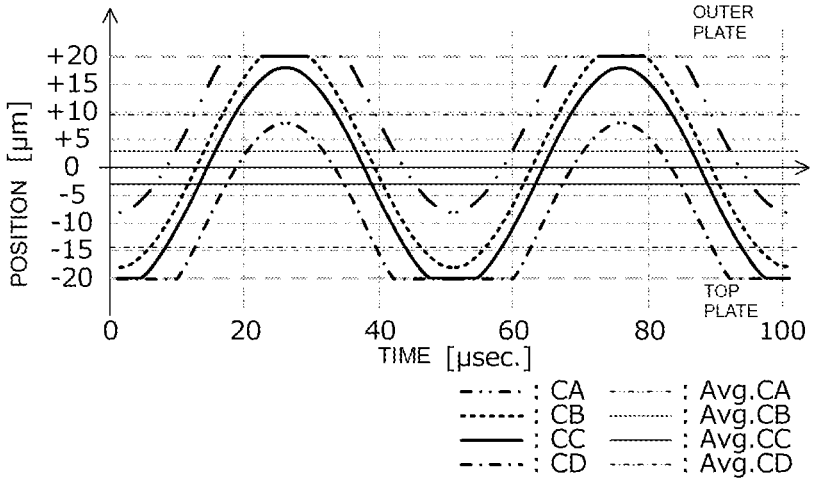
FIG. 24B is a graph illustrating the states of a valve in a valve chamber when the relationship between the pressure and the flow rate illustrated in FIG. 24A is state A, state B, state C, and state D.

In this configuration, the following issue may occur in the valve 130 of the piezoelectric pump 10. FIG. 24A is a graph illustrating the relationship between the pressure and the flow rate. Here, the pressure means the difference (differential pressure) between the external pressure of the piezoelectric pump 10 near the diaphragm 111 and the pressure inside the pressure vessel 12 near the outer plate 114. FIG. 24B is a graph illustrating the states of the valve in the valve chamber when the relationship between the pressure and the flow rate illustrated in FIG. 24A is state A, state B, state C, and state D. FIG. 24B illustrates the shapes and average positions of the valve at certain timings. In FIG. 24B, the "+" side represents positions near the outer plate 114, and the "−" side represents positions near the top plate 113. A larger absolute value represents a position closer to the outer plate 114 or the top plate 113. In FIG. 24B, curves CA, CB, CC, and CD represent the shapes in state A, state B, state C, and state D, respectively, and straight lines Avg.CA, Avg.CB, Avg.CC, and Avg.CD represent average positions in state A, state B, state C, and state D, respectively.

When the pressure vessel 12 is attached to the piezoelectric pump 10, the pressure decreases as the flow rate increases, and the flow rate decreases as the pressure increases, as illustrated in FIG. 24A.

Specifically, when the amount of the air flowing into the pressure vessel 12 is small and the pressure is low, the flow rate is high. This phenomenon occurs, for example, at startup of the fluid control device. This state is referred to as a flow-rate mode.

On the other hand, when the amount of the air flowing into the pressure vessel 12 is large and the pressure is high, the flow rate is low. This phenomenon occurs, for example, when the fluid control device is driven and the piezoelectric pump 10 causes a large amount of the air to flow into the pressure vessel 12. This state is referred to as a pressure mode.

State A illustrated in FIG. 24A corresponds to the flow-rate mode, and state D corresponds to the pressure mode. State B and state C correspond to an intermediate state thereof (intermediate mode). State B is closer to state A, and state C is closer to state D.

As illustrated in FIG. 24B, in state A (flow-rate mode), the valve 130 is basically closer to the outer plate 114 than to the top plate 113, and the speed of collision to the outer plate 114 is high.

On the other hand, in state D (pressure mode), the valve 130 is basically closer to the top plate 113 than to the outer plate 114, and the speed of collision to the top plate 113 is high.

In state B and state C (intermediate mode), the valve 130 is basically near the center of the valve chamber 120 in the height direction, and the speed of collision to the top plate 113 and the outer plate 114 is lower than in state A and state D.

Figure 25A:
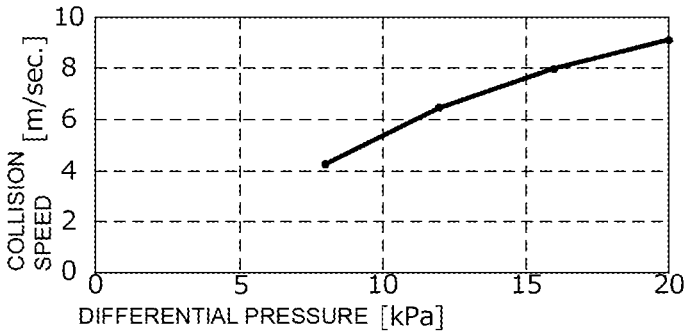
FIGS. 25A and 25B are graphs illustrating the relationships between the differential pressure and the collision speed.
Figure 25B:
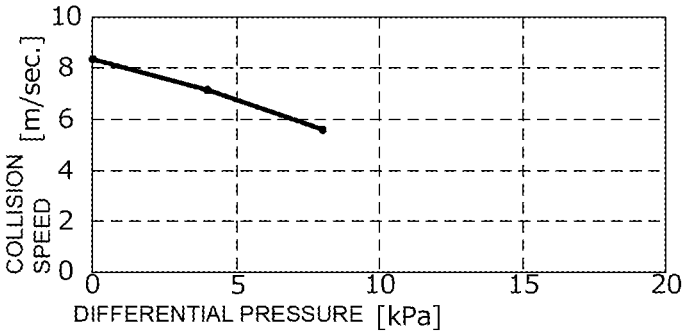
Figure 25C:
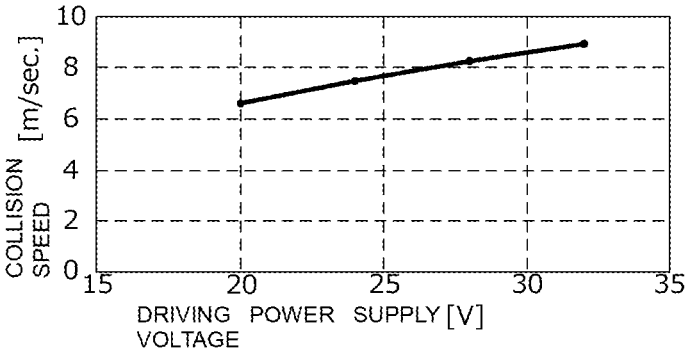
FIG. 25C is a graph illustrating the relationship between the driving power supply voltage and the collision speed.

FIGS. 25A and 25B are graphs illustrating the relationships between the differential pressure and the collision speed, and FIG. 25C is a graph illustrating the relationship between the driving power supply voltage and the collision speed. FIG. 25A illustrates the speed of collision between the valve and the outer plate in state A (flow-rate mode), FIG. 25B illustrates the speed of collision between the valve and the top plate in state D (pressure mode), and FIG. 25C illustrates a case where the differential pressure is zero.

As illustrated in FIG. 25A, in state A (flow-rate mode), the valve and the outer plate collide with each other at high speed, and the collision speed increases as the differential pressure increases. Thus, in state A (flow-rate mode), the valve 130 is likely to collide with the outer plate 114 to be broken.

As illustrated in FIG. 25B, in state D (pressure mode), the valve and the top plate collide with each other at high speed, and the collision speed increases as the differential pressure decreases. Thus, in state D (pressure mode), the valve 130 is likely to collide with the top plate 113 to be broken.

As illustrated in FIG. 25C, the collision speed increases as the driving power supply voltage increases.

Thus, the above-described drive control circuit is controlled in the following manner.

(Control for Flow-Rate Mode)

Figure 26A:
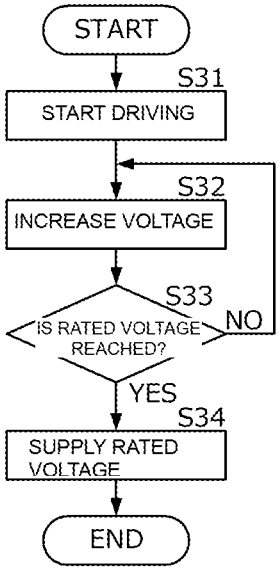
FIGS. 26A and 26B are flowcharts illustrating control of the driving power supply voltage.
Figure 26B:
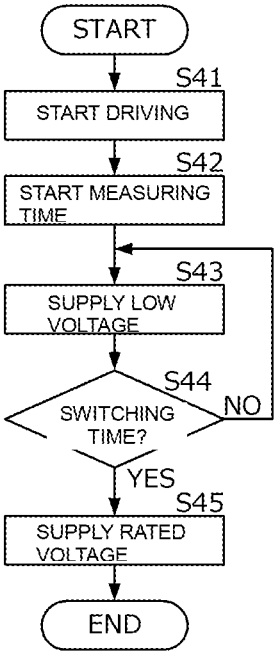
Figure 27A:
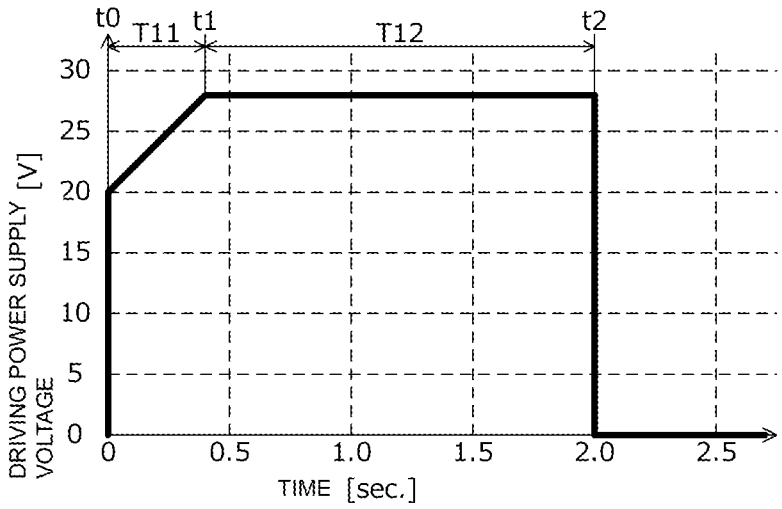
FIGS. 27A and 27B are graphs illustrating chronological changes in the driving power supply voltage.
Figure 27B:
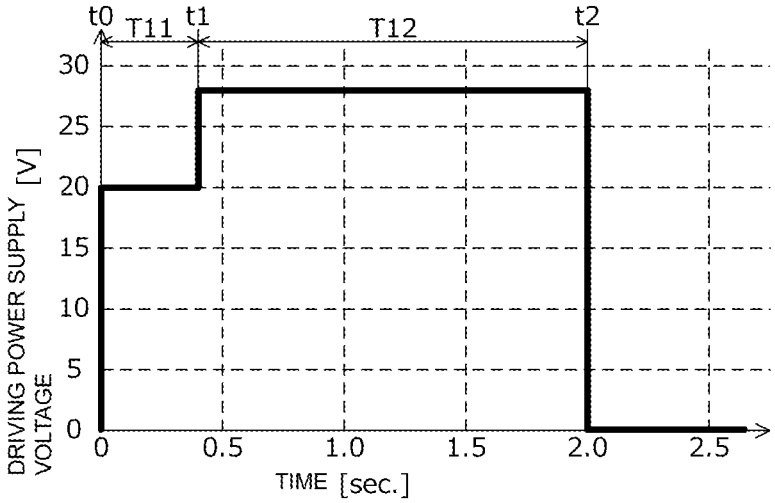

FIGS. 26A and 26B are flowcharts illustrating control of the driving power supply voltage. FIGS. 27A and 27B are graphs illustrating chronological changes in the driving power supply voltage. FIG. 27A corresponds to the flowchart in FIG. 26A, and FIG. 27B corresponds to the flowchart in FIG. 26B.

In the control illustrated in FIG. 26A, the fluid control device starts supplying a driving power supply voltage with the on-off valve 13 being closed (S31). The initial value of the driving power supply voltage is set to a voltage value (20 V in the example in FIG. 27A) lower than the constant-operation driving power supply voltage (28 V in the example in FIG. 27A), as illustrated in FIG. 27A.

The fluid control device gradually increases the driving power supply voltage over time (S32). That is, the fluid control device increases the driving power supply voltage at a predetermined increase rate. For example, the fluid control device increases the driving power supply voltage by a predetermined voltage per second. For example, in the example illustrated in FIG. 27A, the fluid control device increases the driving power supply voltage by 20 V per second. At this time, the voltage may be increased continuously as illustrated in FIG. 27A or discretely (stepwise).

The fluid control device increases the driving power supply voltage (S32) until the driving power supply voltage reaches the rated voltage (the constant-operation driving power supply voltage) (NO in S33). When the driving power supply voltage reaches the rated voltage (the constant-operation driving power supply voltage) (YES in S33), the fluid control device supplies the rated voltage (S34).

In the example in FIG. 27A, the fluid control device gradually increases the driving power supply voltage during a first period T11 from time t0 when the driving is started to time t1 when the driving power supply voltage reaches the rated voltage. Subsequently, the fluid control device supplies the rated voltage during a second period T12 from time t1 to time t2 when the on-off valve 13 is opened. The fluid control device stops supplying the driving power supply voltage at time t2.

The control of the driving power supply voltage can be performed by using the above-described drive control circuit illustrated in FIGS. 14A and 14B, and FIG. 18.

In the control illustrated in FIG. 26B, the fluid control device starts supplying a driving power supply voltage with the on-off valve 13 being closed (S41). The initial value of the driving power supply voltage is set to a predetermined voltage value (low voltage: 20 V in the example in FIG. 27B) lower than the constant-operation driving power supply voltage (28 V in the example in FIG. 27B), as illustrated in FIG. 27B. At this timing, the fluid control device starts measuring time (S42).

The fluid control device continues supplying the low voltage (S43) until a voltage switching time is detected (NO in S44).

When the fluid control device detects a voltage switching time (YES in S44), the fluid control device supplies the rated voltage (S45).

In the example in FIG. 27B, the fluid control device supplies an initial constant voltage lower than the rated voltage during the first period T11 from time t0 when the driving is started to time t1 which is a switching time. Subsequently, the fluid control device supplies the rated voltage during the second period T12 from time t1 to time t2 when the on-off valve 13 is opened. The fluid control device stops supplying the driving power supply voltage at time t2.

The control of the driving power supply voltage can be performed by using the above-described drive control circuit illustrated in FIGS. 14A and 14B, and FIG. 18.

With this control, the driving power supply voltage to be supplied to the piezoelectric pump 10 can be suppressed when the above-described flow-rate mode occurs. Thus, the collision of the valve 130 with the outer plate 114 and breakdown of the valve 130 can be prevented. In addition, the control illustrated in FIG. 26B enables the piezoelectric pump 10 to perform a constant operation earlier. On the other hand, the control illustrated in FIG. 26A enables the control of the driving power supply voltage to be simplified and the circuit configuration to be simplified, for example.

Figure 28A:
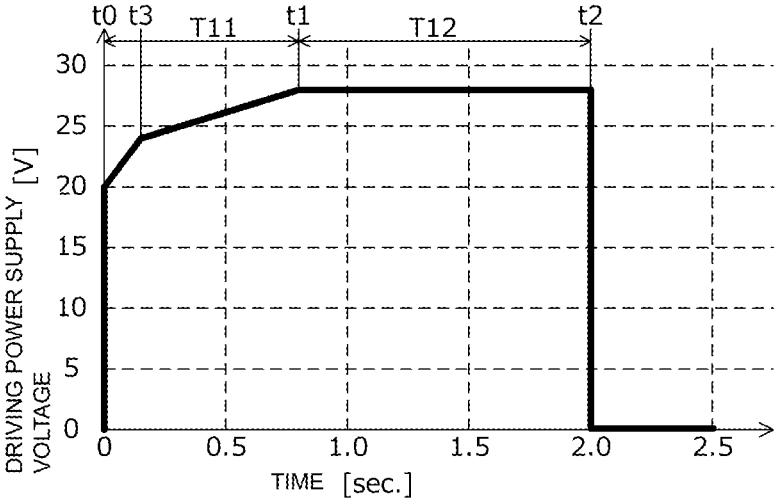
FIGS. 28A and 28B are graphs illustrating chronological changes in the driving power supply voltage.
Figure 28B:
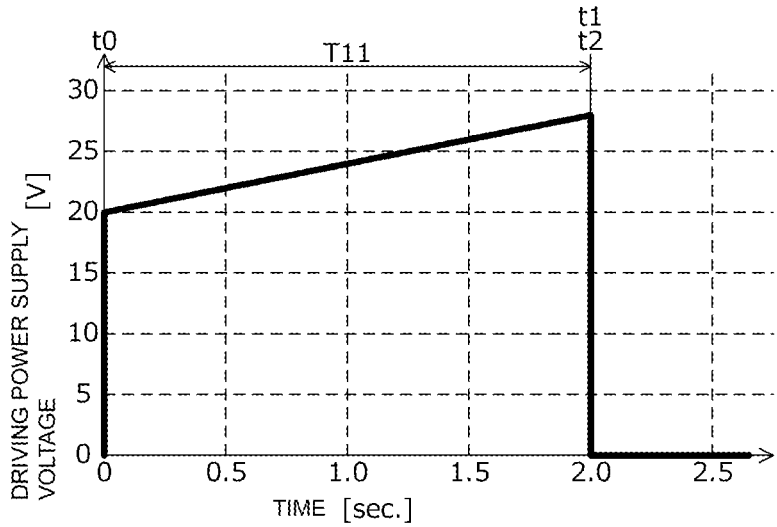

The fluid control device may perform the control illustrated in FIGS. 28A and 28B. FIGS. 28A and 28B are graphs illustrating chronological changes in the driving power supply voltage.

In the control illustrated in FIG. 28A, a plurality of voltage increase rates are set in the first period. In FIG. 28A, the increase rate in the initial stage is higher than the increase rate in the following stage, but the converse may also be applied. However, when the increase rate in the initial stage is higher than the increase rate in the following stage, the piezoelectric pump can be started more quickly. On the other hand, when the increase rate in the initial stage is lower than the increase rate in the following stage, the breakage of the valve can be suppressed more effectively.

In the control illustrated in FIG. 28B, setting is made so that the driving power supply voltage is continuously increased from the timing to start supplying the driving power supply voltage to the timing to stop supplying the driving power supply voltage and so that the driving power supply voltage reaches the rated voltage at the timing of open control.

In the above-described control for the flow-rate mode, it is sufficient that the drive control circuit at least increase the driving power supply voltage before the supply of the driving power supply voltage is stopped. However, for example, the time calculated by multiplying a time difference between a supply start time and supply stop time of the driving power supply voltage by a predetermined value (a value smaller than 1) and adding the product to the supply start time is regarded as an intermediate time. It is preferable for the drive control circuit to perform control so that the driving power supply voltage at the intermediate time is higher than the driving power supply voltage immediately after the supply start time. The predetermined value may be, for example, about 0.5. With the use of this value, for example, the drive efficiency of the piezoelectric pump 10 can be increased while suppressing the breakage of the above-described valve.

In the above description, voltage control is performed by using the time elapsed from the timing to start supplying the driving power supply voltage. This uses the one-to-one relationship between the differential pressure and the elapsed time. Thus, the elapsed time may be used if the differential pressure cannot be measured, and voltage control may be performed by using the differential pressure if the differential pressure can be measured.

In this case, for example, the pressure calculated by multiplying a difference between the minimum value of the differential pressure (for example, the differential pressure at the start of supplying the driving power supply voltage) and the maximum value of the differential pressure by a predetermined value (a value smaller than 1) and adding the product to the minimum value is regarded as an intermediate differential pressure. It is preferable for the drive control circuit to perform control so that the driving power supply voltage at the intermediate differential pressure is higher than the driving power supply voltage at the minimum value of the differential pressure. The predetermined value may be, for example, about 0.5. At this value, the intermediate differential pressure is an average of the minimum value and maximum value of the differential pressure. With the use of this value, for example, the drive efficiency of the piezoelectric pump 10 can be increased while suppressing the breakage of the above-described valve.

(Control for Pressure Mode)

Figure 29A:
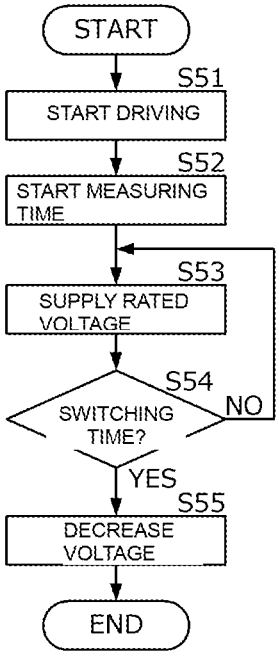
FIGS. 29A and 29B are flowcharts illustrating control of the driving power supply voltage.
Figure 29B:
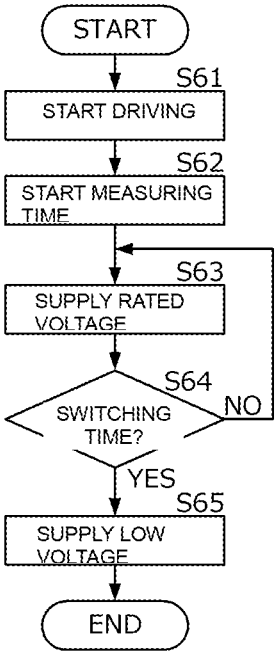
Figure 30A:
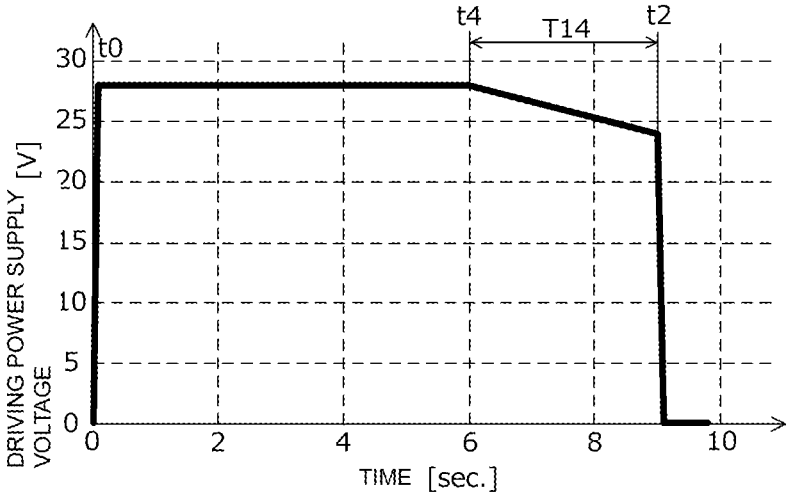
FIGS. 30A and 30B are graphs illustrating chronological changes in the driving power supply voltage.
Figure 30B:
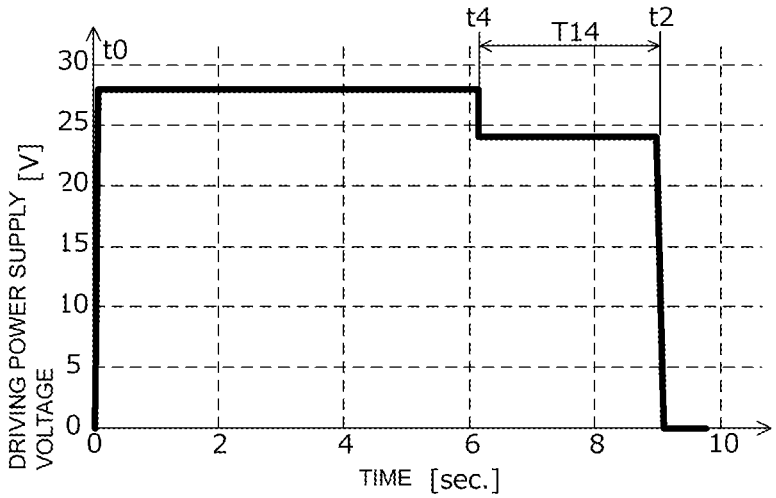

FIGS. 29A and 29B are flowcharts illustrating control of the driving power supply voltage. FIGS. 30A and 30B are graphs illustrating chronological changes in the driving power supply voltage. FIG. 30A corresponds to the flowchart in FIG. 29A, and FIG. 30B corresponds to the flowchart in FIG. 29B.

In the control illustrated in FIG. 29A, the fluid control device starts applying a driving power supply voltage with the on-off valve 13 being closed (S51). The driving power supply voltage is set to, for example, the constant-operation driving power supply voltage (rated voltage: 28 V in the example in FIG. 30A). At this timing, the fluid control device starts measuring time (S52).

The fluid control device continues supplying the rated voltage (S53) until a voltage switching time is detected (NO in S54).

When the fluid control device detects the voltage switching time (YES in S54), the fluid control device gradually decreases the driving power supply voltage over time (S55). That is, the fluid control device decreases the driving power supply voltage at a predetermined decrease rate. For example, the fluid control device decreases the driving power supply voltage by a predetermined voltage per second. For example, in the example illustrated in FIG. 30A, the fluid control device decreases the driving power supply voltage by 1.3 V per second. At this time, the voltage may be decreased continuously as illustrated in FIG. 30A or discretely (stepwise).

In the example in FIG. 30A, the fluid control device supplies the rated voltage during a period from time t0 when the driving is started to time t4 which is the switching time. Subsequently, the fluid control device gradually decreases the driving power supply voltage over time during a third period T14 from time t4 to time t2 when the on-off valve 13 is opened. The fluid control device stops supplying the driving power supply voltage at time t2.

The control of the driving power supply voltage can be performed by using a derivative circuit that is based on the above-described drive control circuit illustrated in FIGS. 14A and 14B, and FIG. 18.

In the control illustrated in FIG. 29B, the fluid control device starts applying a driving power supply voltage with the on-off valve 13 being closed (S61). The driving power supply voltage is set to, for example, the constant-operation driving power supply voltage (rated voltage: 28 V in the example in FIG. 30B). At this timing, the fluid control device starts measuring time (S62).

The fluid control device continues supplying the rated voltage (S63) until a voltage switching time is detected (NO in S64).

When the fluid control device detects a voltage switching time (YES in S64), the fluid control device supplies a predetermined voltage (low voltage: 24 V in the example in FIG. 30B) lower than the constant-operation driving power supply voltage (28 V in the example in FIG. 30B), as illustrated in FIG. 30B (S65).

In the example in FIG. 30B, the fluid control device supplies the rated voltage during a period from time t0 when the driving is started to time t4 which is a switching time. Subsequently, the fluid control device supplies a constant voltage lower than the rated voltage during the third period T14 from time t4 to time t2 when the on-off valve 13 is opened. The fluid control device stops supplying the driving power supply voltage at time t2.

The control of the driving power supply voltage can be performed by using the above-described drive control circuit illustrated in FIG. 4 and FIG. 7.

With this control, the driving power supply voltage to be supplied to the piezoelectric pump 10 can be suppressed when the above-described pressure mode occurs. Thus, the collision of the valve 130 with the top plate 113 and breakage of the valve 130 can be suppressed. In addition, the control illustrated in FIG. 30B makes it possible to maintain for a longer time a state where the operation of the piezoelectric pump 10 is close to a constant operation. On the other hand, the control illustrated in FIG. 30B enables the control of the driving power supply voltage to be simplified and the circuit configuration to be simplified, for example.

Figure 31A:
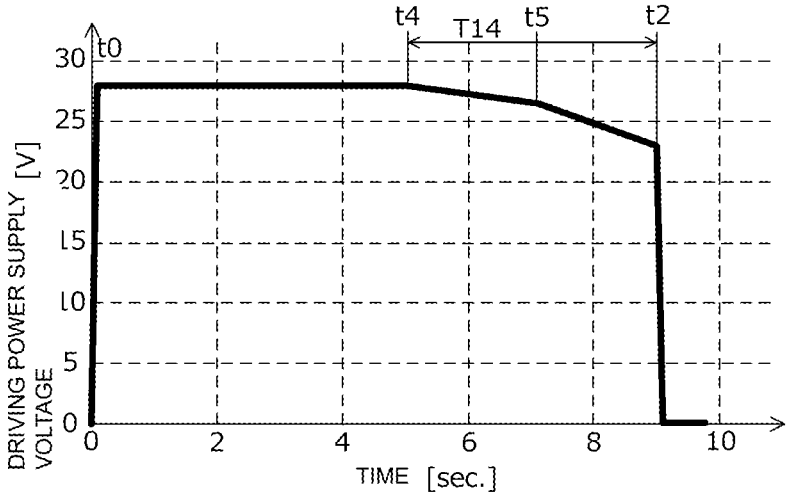
FIGS. 31A and 31B are graphs illustrating chronological changes in the driving power supply voltage.
Figure 31B:
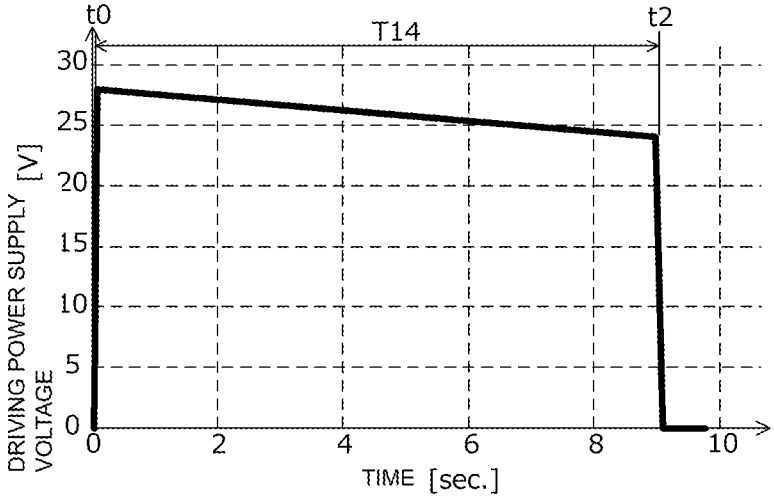

The fluid control device may perform the control illustrated in FIGS. 31A and 31B. FIGS. 31A and 31B are graphs illustrating chronological changes in the driving power supply voltage.

In the control illustrated in FIG. 31A, a plurality of voltage decrease rates are set in the third period. FIG. 31A illustrates the mode in which the decrease rate during decompression is lower in the initial stage than in the following stage, but the converse may also be applied. However, when the decrease rate in the initial stage is lower than the decrease rate in the following stage, the performance of the piezoelectric pump can be kept close to the rating for a longer time. On the other hand, when the decrease rate in the initial stage is higher than the decrease rate in the following stage, the breakage of the valve can be suppressed more effectively.

In the control illustrated in FIG. 31B, the driving power supply voltage is continuously decreased from the timing to start supplying the driving power supply voltage to the timing to stop supplying the driving power supply voltage.

At this time, it is sufficient that the drive control circuit at least decrease the driving power supply voltage before the supply of the driving power supply voltage is stopped. However, for example, the time calculated by multiplying a time difference between a supply start time and supply stop time of the driving power supply voltage by a predetermined value (a value smaller than 1) and subtracting the product from the supply stop time is regarded as an intermediate time. It is preferable for the drive control circuit to perform control so that the driving power supply voltage immediately before the supply stop time is lower than the driving power supply voltage at the intermediate time. The predetermined value may be, for example, about 0.5. With the use of this value, for example, the drive efficiency of the piezoelectric pump 10 can be increased while suppressing the breakage of the above-described valve.

In the above description, voltage control is performed by using the time until the drive stop timing. This uses the one-to-one relationship between the differential pressure and the time until the drive stop timing. Thus, the time until the drive stop timing may be used if the differential pressure cannot be measured, and voltage control may be performed by using the differential pressure if the differential pressure can be measured.

In this case, for example, the pressure calculated by multiplying a difference between the minimum value of the differential pressure (for example, the differential pressure at the start of supplying the driving power supply voltage) and the maximum value of the differential pressure by a predetermined value (a value smaller than 1) and adding the product to the minimum value is regarded as an intermediate differential pressure. It is preferable for the drive control circuit to perform control so that the driving power supply voltage at the maximum value of the differential pressure is lower than the driving power supply voltage at the intermediate differential pressure. The predetermined value may be, for example, about 0.5. At this value, the intermediate differential pressure is an average of the minimum value and maximum value of the differential pressure. With the use of this value, for example, the drive efficiency of the piezoelectric pump 10 can be increased while suppressing the breakage of the above-described valve.

In the above description, control for the flow-rate mode and control for the pressure mode are individually performed, but these control operations may be performed in combination. Accordingly, breakage of the valve can be suppressed more reliably and effectively.

In the above-description, the driving power supply voltage is controlled and adjusted. Alternatively, the driving current or driving power corresponding to the driving power supply voltage may be controlled and adjusted.

In the above-described embodiments, a high-side voltage is controlled for the piezoelectric pump 10. Alternatively, a low-side voltage may be controlled, or both a high-side voltage and a low-side voltage may be controlled.

Figure 32A:
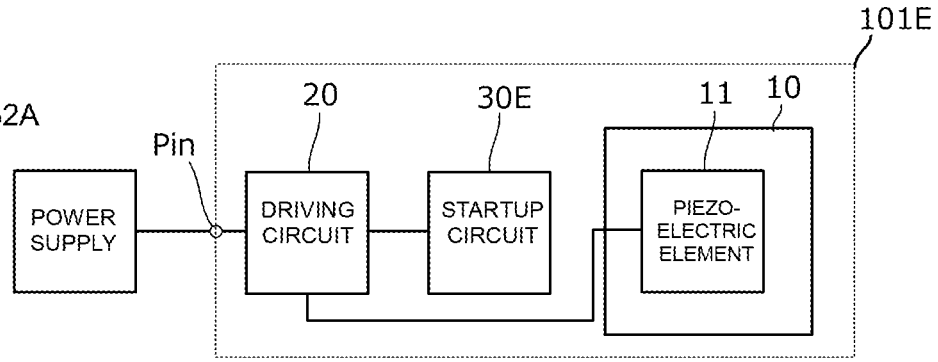
FIG. 32A is a functional block diagram of a fluid control device in the case of performing control in a low side.
Figure 32B:
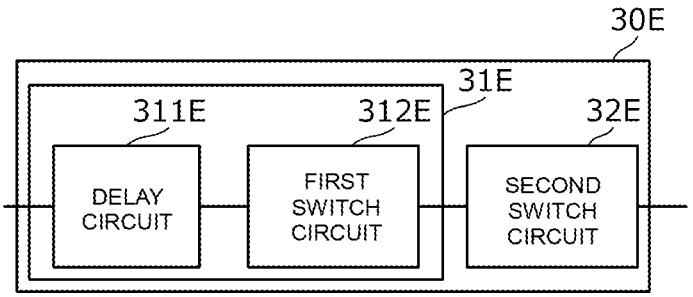
FIG. 32B is a functional block diagram of the startup circuit illustrated in FIG. 32A.
Figure 32C:
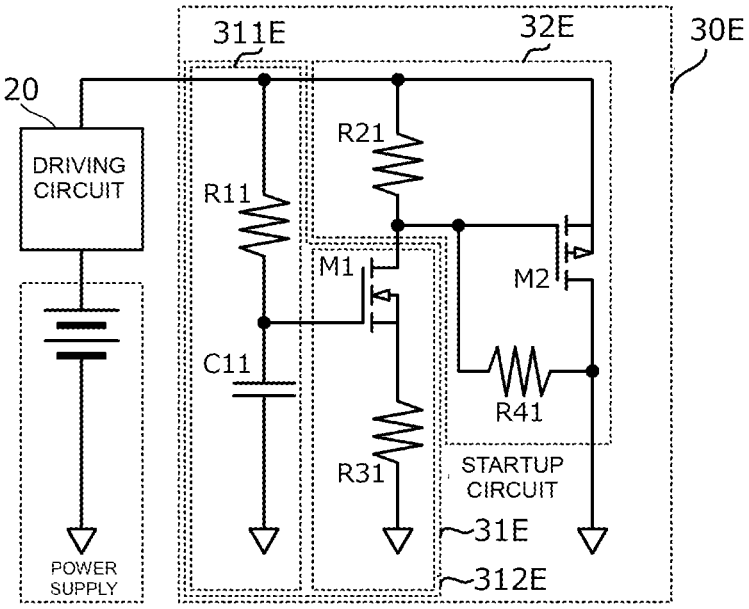
FIG. 32C is a circuit diagram illustrating an example of the startup circuit.

FIG. 32A is a functional block diagram of a fluid control device in the case of performing control in the low side, FIG. 32B is a functional block diagram of the startup circuit illustrated in FIG. 32A, and FIG. 32C is a circuit diagram illustrating an example of the startup circuit.

As illustrated in FIGS. 32A, 32B and 32C, a fluid control device 101E includes the piezoelectric pump 10, the driving circuit 20, and a startup circuit 30E. The startup circuit 30E includes a delay circuit 311E, a first switch circuit 312E, and a second switch circuit 32E. The delay circuit 311E and the first switch circuit 312E constitute a first circuit 31E.

As illustrated in FIG. 32A, in the fluid control device 101E, the driving circuit 20 is connected between the power supply (power supply voltage input terminal Pin) and the startup circuit 30E. Except for this, the configuration of the fluid control device 101E is similar to that of the fluid control device including the startup circuit 30D illustrated in FIGS. 20A and 20B, and the description of similar parts will not be given.

In this case, as illustrated in FIG. 32C, the driving circuit 20 is connected to the positive pole of the power supply, and the resistance element R11 of the startup circuit 30E is connected to the terminal of the driving circuit 20 opposite to the terminal connected to the power supply. The drain of the FET M2 of the startup circuit 30E is connected to the reference potential.

In the above description, pressure is applied to the pressure vessel 12 by the piezoelectric pump 10. Alternatively, the pressure in the pressure vessel 12 may be decreased by the piezoelectric pump 10.

Figure 33:
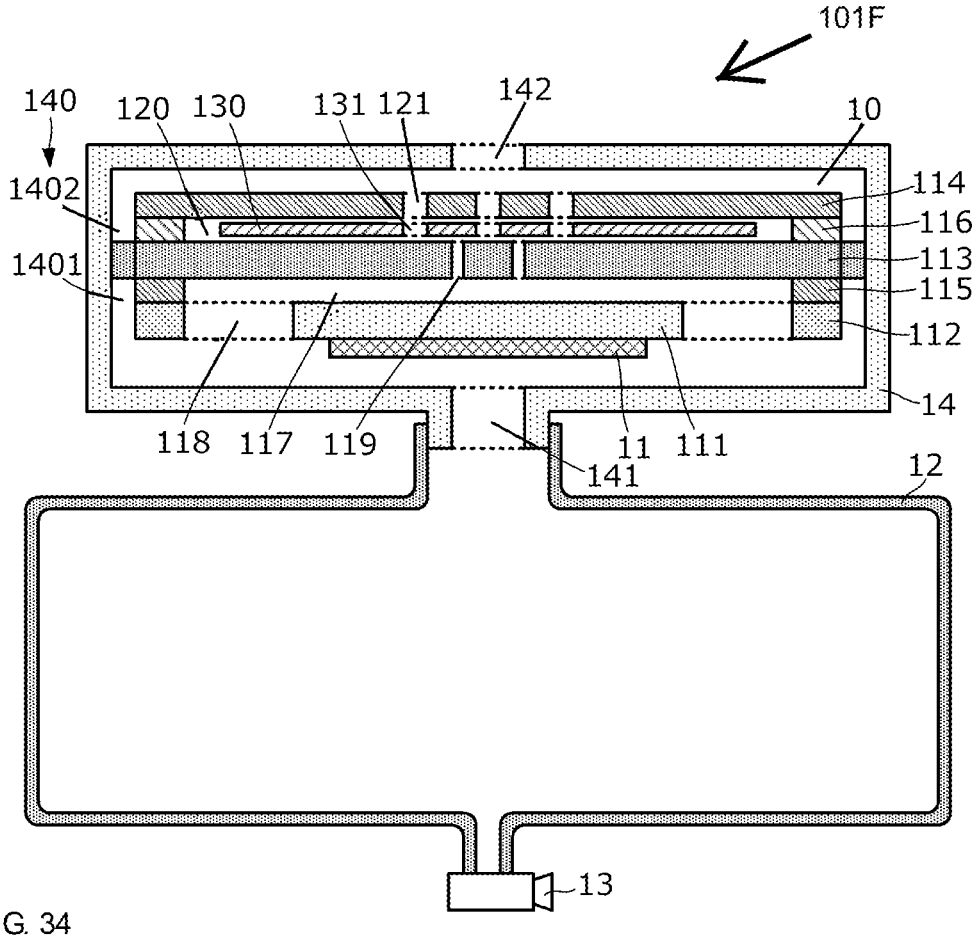
FIG. 33 is a side cross-sectional view illustrating a connection configuration of a piezoelectric pump to be used for decompression, a pressure vessel, and an on-off valve.

In this case, for example, the fluid control device may have the following configuration. FIG. 33 is a side cross-sectional view illustrating a connection configuration of a piezoelectric pump to be used for decompression, a pressure vessel, and an on-off valve.

As illustrated in FIG. 33, a fluid control device 101F includes the piezoelectric pump 10, the pressure vessel 12, the on-off valve 13, and a housing 14. The housing 14 has an internal space 140 and includes an inlet 141 and an outlet 142. The piezoelectric pump 10 is disposed in the internal space 140 of the housing 14. The piezoelectric pump 10 is disposed so as to divide the internal space 140 into a first space 1401 and a second space 1402. The first space 1401 communicates with the inlet 141, and the second space 1402 communicates with the outlet 142. In the piezoelectric pump 10, the gap 118 communicates with the first space 1401, and the through-hole 121 communicates with the second space 1402.

The pressure vessel 12 is disposed so as to cover the inlet 141, and the internal space of the pressure vessel 12 communicates with the inlet 141. The on-off valve 13 is attached to a hole different from a hole communicating with the inlet 141 in the pressure vessel 12.

With this mode of decompressing the pressure vessel 12, functions and effects similar to those in the above-described mode of applying pressure to the pressure vessel 12 can be obtained.

The pressure vessel 12 described in the foregoing embodiments is not limited to the one having an enclosed space and the on-off valve 13. Any other thing may be used as long as the pressure therein is changed by receiving a fluid from the piezoelectric pump 10, for example, gauze or the like used for NPWT.

In the above-described embodiments, the gap 118 serves as an inlet and the through-hole 121 serves as an outlet. When the through-hole 131 is disposed so as to overlap with the through-hole 119 and not to overlap with the through-hole 121, the gap 118 may serve as an outlet and the through-hole 121 may serve as an inlet. Also in this case, similar effects can be obtained.

Finally, the above-described embodiments are examples in all points and are not restrictive. Modifications and changes can appropriately be made by a person skilled in the art. The scope of the present disclosure is defined by the scope of the claims, not by the above-described embodiments. Furthermore, changes from the embodiments within the scope equivalent to the scope of the claims are included in the scope of the present disclosure.

C1, C2, C11: capacitor
Ccb: parasitic capacitor
D1, Dcb, Dce, D11: diode
P1: first stage
P2: second stage
P3: third stage
Pin: power supply voltage input terminal
Q1: first MOS-FET
Q10: MOS-FET
Q11: parasitic transistor (switch element)
Q2: second MOS-FET
M1, M2, M3: FET
R2, R1, R11, R21, R31, R41: resistor
Rb: parasitic resistor
V1: peak voltage
10: piezoelectric pump
11: piezoelectric element
12: pressure vessel
13: on-off valve
20: driving circuit
21, 21C: drive control circuit
30: startup circuit
30D: drive control circuit
31: first circuit
311D: delay circuit
312: first switch circuit
32: second circuit
33D: reset circuit
40: actuator
41: diaphragm
42: piezoelectric element
43: reinforcing plate
51: thin top plate
52: center vent
53A, 53B, 53C: spacer
54: cover portion
55: discharge hole
61: diaphragm supporting frame
71: electrode conduction plate
91: base plate
92: opening portion
101, 101F: fluid control device
105: piezoelectric pump
111: diaphragm
112: supporting body
113: top plate
114: outer plate
115: frame body
116: frame body
117: pump chamber
118: gap
120: valve chamber

121: through-hole
130: valve
131: through-hole
140: internal space
141: inlet
142: outlet
1401: first space
1402: second space
211: current detection circuit
220: control IC
221: comparator
222: time constant circuit
223: discharge circuit
231: switch
311: first switch element
312: first delay circuit
321: second switch element
322: second delay circuit

The invention claimed is:

1. A fluid control device comprising:

a piezoelectric pump having a piezoelectric element;

a driving circuit that receives a driving power supply voltage applied thereto and drives the piezoelectric element; and a startup circuit disposed between the driving circuit and an input terminal for the driving power supply voltage, wherein:

the startup circuit increases the driving power supply voltage to a voltage lower than a constant voltage in a first stage after startup, maintains or decreases the driving power supply voltage in a second stage following the first stage, and increases the driving power supply voltage to the constant voltage in a third stage following the second stage, the startup circuit comprises a first circuit constituting a first path and a second circuit constituting a second path, the first circuit and the second circuit applying the driving power supply voltage to the driving circuit, the first circuit is a circuit that conducts over at least a period of the first stage from when the power supply voltage is applied to the input terminal and that does not conduct over a period of the third stage, and the second circuit is a circuit that conducts after the second stage.

2. The fluid control device according to claim 1, wherein the driving power supply voltage during a transition from the second stage to the third stage is higher than or equal to the driving power supply voltage at a start of the first stage.

3. The fluid control device according to claim 1, wherein the first circuit comprises:

a first switch element that applies the driving power supply voltage to the driving circuit, and a first delay circuit that causes the first switch element to conduct over the period of the first stage after the driving power supply voltage is applied and not to conduct over the period of the third stage.

4. The fluid control device according to claim 3, wherein the first switch element and the first delay circuit are constituted by a first MOS-FET, the first switch element is a parasitic transistor including a collector which is a drain of the first MOS-FET and an emitter which is a source of the first MOS-FET, and the first delay circuit is a CR time constant circuit including a parasitic capacitor of the first MOS-FET formed between a base of the parasitic transistor and the collector, and a parasitic resistor of the first MOS-FET formed between the base and the emitter.

5. The fluid control device according to claim 1, wherein:

the startup circuit:

includes a semiconductor element for controlling the driving power supply voltage, and outputs the driving power supply voltage by using the first stage and the second stage, wherein:

during the first stage the driving power supply voltage is increased to the voltage lower than the constant voltage by using a voltage division ratio for the power supply voltage between the driving circuit and a resistance element when the semiconductor element is in an off state, and during the second stage the driving power supply voltage is gradually increased to the constant voltage by using an unsaturated region of the semiconductor element.

6. The fluid control device according to claim 5, wherein the startup circuit further includes a reset circuit that resets output control of the driving power supply voltage using the first stage and the second stage.

7. A fluid control device comprising:

a piezoelectric pump having a piezoelectric element;

a driving circuit that receives a driving power supply voltage applied thereto and drives the piezoelectric element; and a startup circuit disposed between the driving circuit and an input terminal for the driving power supply voltage, wherein:

the startup circuit increases the driving power supply voltage to a voltage lower than a constant voltage in a first stage after startup, maintains or decreases the driving power supply voltage in a second stage following the first stage, and increases the driving power supply voltage to the constant voltage in a third stage following the second stage, and wherein:

the startup circuit:

includes a semiconductor element for controlling the driving power supply voltage, and outputs the driving power supply voltage by using the first stage and the second stage, wherein:

during the first stage the driving power supply voltage is increased to the voltage lower than the constant voltage by using a voltage division ratio for the power supply voltage between the driving circuit and a resistance element when the semiconductor element is in an off state, and during the second stage the driving power supply voltage is gradually increased to the constant voltage by using an unsaturated region of the semiconductor element.

* * * * *